US009622512B2

(12) United States Patent
Partsch, IV

(10) Patent No.: US 9,622,512 B2
(45) Date of Patent: Apr. 18, 2017

(54) FASHION AND FUNCTIONAL GARMENT STAYS

(71) Applicant: George J. Partsch, IV, Norco, CA (US)

(72) Inventor: George J. Partsch, IV, Norco, CA (US)

( * ) Notice: Subject to any disclaimer, the term of this patent is extended or adjusted under 35 U.S.C. 154(b) by 0 days.

(21) Appl. No.: 14/141,414

(22) Filed: Dec. 26, 2013

(65) Prior Publication Data

US 2014/0173809 A1 Jun. 26, 2014

Related U.S. Application Data

(60) Provisional application No. 61/848,170, filed on Dec. 26, 2012.

(51) Int. Cl.
*A41B 3/06* (2006.01)

(52) U.S. Cl.
CPC ..... *A41B 3/06* (2013.01)

(58) Field of Classification Search
CPC .... A41B 3/06; A41B 3/08; A41B 1/14; A41B 1/10; A41B 1/20; A41D 27/06; A41C 1/14
USPC ..... 2/255, 256, 257, 120, 128
See application file for complete search history.

(56) References Cited

U.S. PATENT DOCUMENTS

| | | | | |
|---|---|---|---|---|
| 139,937 | A | | 6/1873 | Wieser |
| 153,444 | A | | 7/1874 | Maurer |
| 270,087 | A | | 1/1883 | Lynch |
| 560,085 | A | | 5/1896 | Determan |
| 575,839 | A | | 1/1897 | Jaberg |
| 864,585 | A | | 8/1907 | Worth |
| 1,098,638 | A | | 6/1914 | Rees |
| 1,534,174 | A | | 4/1924 | Frank |
| 2,595,133 | A | | 9/1948 | Golden |
| 2,467,117 | A | | 4/1949 | Dukes, Jr. |
| 3,208,082 | A | | 9/1965 | Di Paolo |
| 3,311,926 | A | | 4/1967 | Gerber |
| 3,531,807 | A | * | 10/1970 | Devito et al. ..... 2/256 |
| 3,787,896 | A | | 1/1974 | Weiss |
| 4,616,366 | A | | 10/1986 | Mueller |
| 4,688,271 | A | * | 8/1987 | Capelle ..... A41F 9/00 2/220 |
| 4,825,472 | A | * | 5/1989 | Garafano ..... 2/116 |
| 5,337,457 | A | * | 8/1994 | Chennault ..... 24/66.4 |
| 5,626,267 | A | * | 5/1997 | Peruski ..... A41B 3/06 2/129 |
| 6,550,109 | B2 | * | 4/2003 | Sims ..... A41B 1/10 2/115 |
| 7,992,222 | B1 | | 8/2011 | Behrens |
| 8,001,619 | B1 | | 8/2011 | Baehring |
| 2002/0069491 | A1 | * | 6/2002 | Sims ..... 24/40 |

(Continued)

*Primary Examiner* — Khaled Annis

(74) *Attorney, Agent, or Firm* — WPAT, P.C., Intellectual Property Attoneys; Anthony King

(57) ABSTRACT

An internal garment stay to detachably attach to a garment in the collar, or placket region. The garment may or may not need modification. Preferably, the garment is an off-the-shelf garment requiring no additional modification to receive these stays. The stays can have various configurations to facilitate insertion and usage, such has having appendages, curvatures, cut-outs, catches. Further, the internal stays can work with external stays such that external stays are visible from the outside so as to show a message, a slogan, a style, a logo (e.g., a sports team logo).

19 Claims, 29 Drawing Sheets

(56) References Cited

U.S. PATENT DOCUMENTS

| | | | |
|---|---|---|---|
| 2003/0135910 | A1 | 7/2003 | Young, Jr. |
| 2007/0028368 | A1 | 2/2007 | Morton |
| 2007/0044198 | A1 | 3/2007 | Whicker |
| 2011/0099686 | A1 | 5/2011 | Carter |
| 2011/0173740 | A1 | 7/2011 | Franklin |
| 2012/0278973 | A1 | 11/2012 | Berkowitz et al. |

* cited by examiner 42
19
19
19

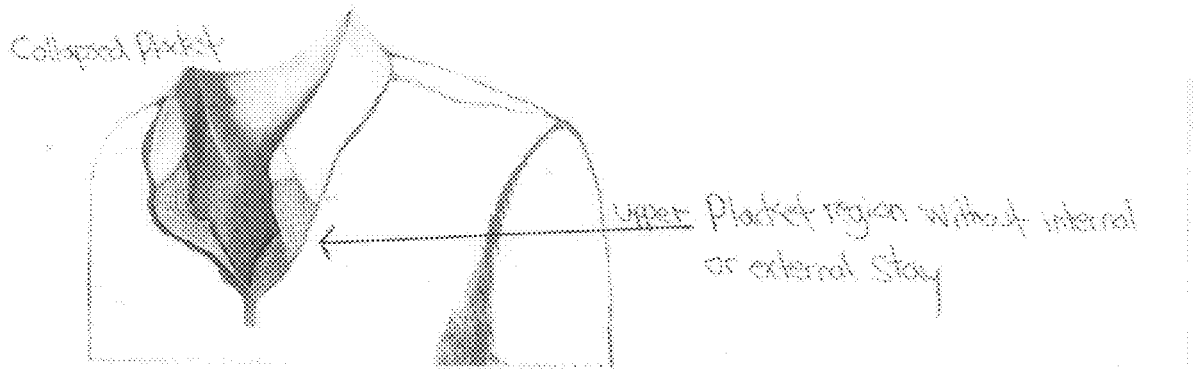
Figure 20
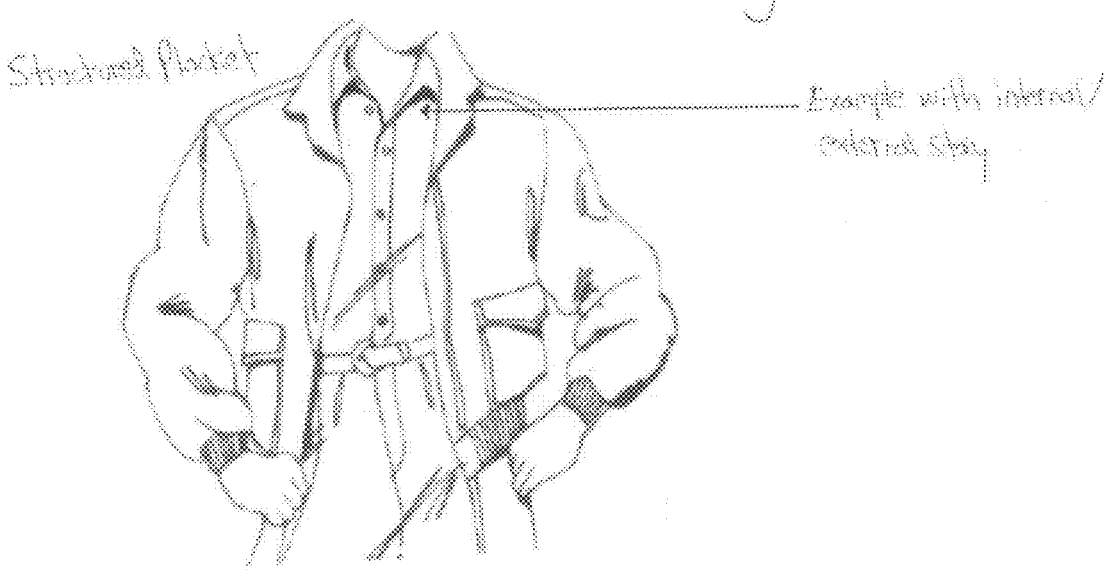

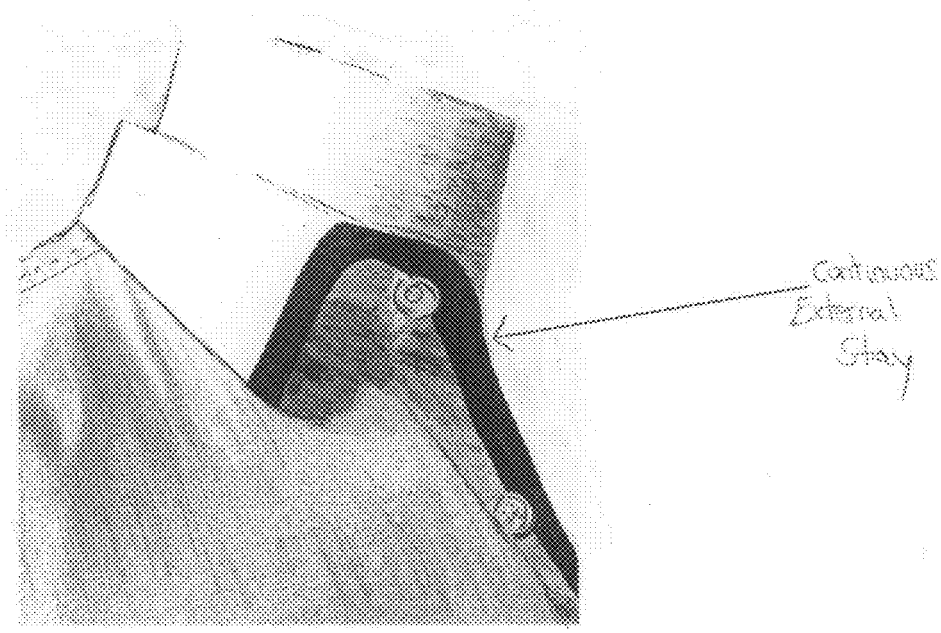
Figure 21
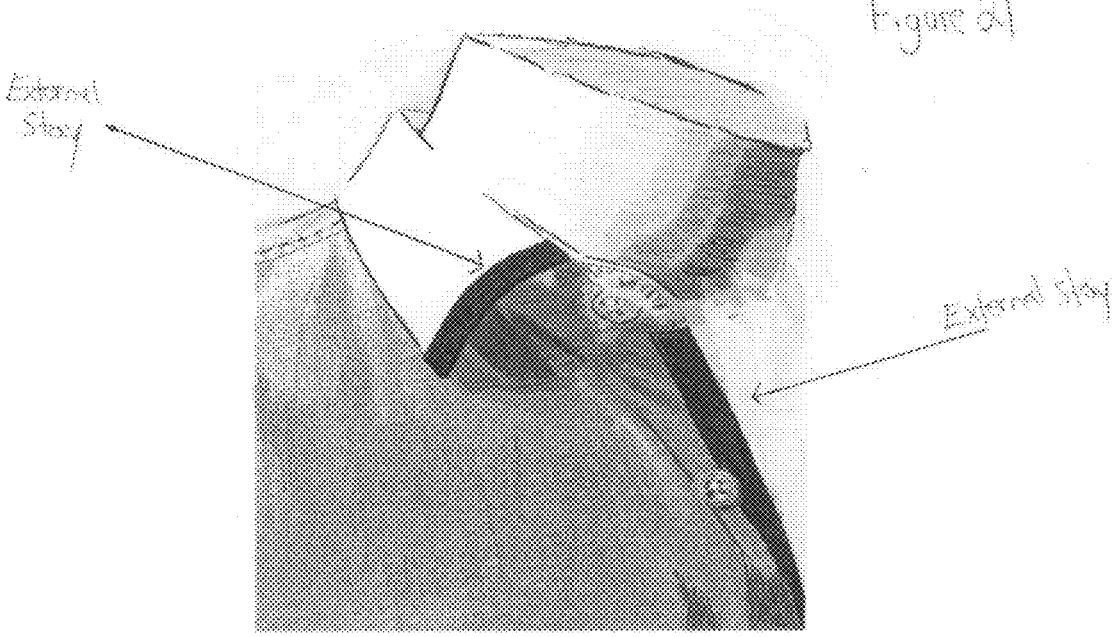

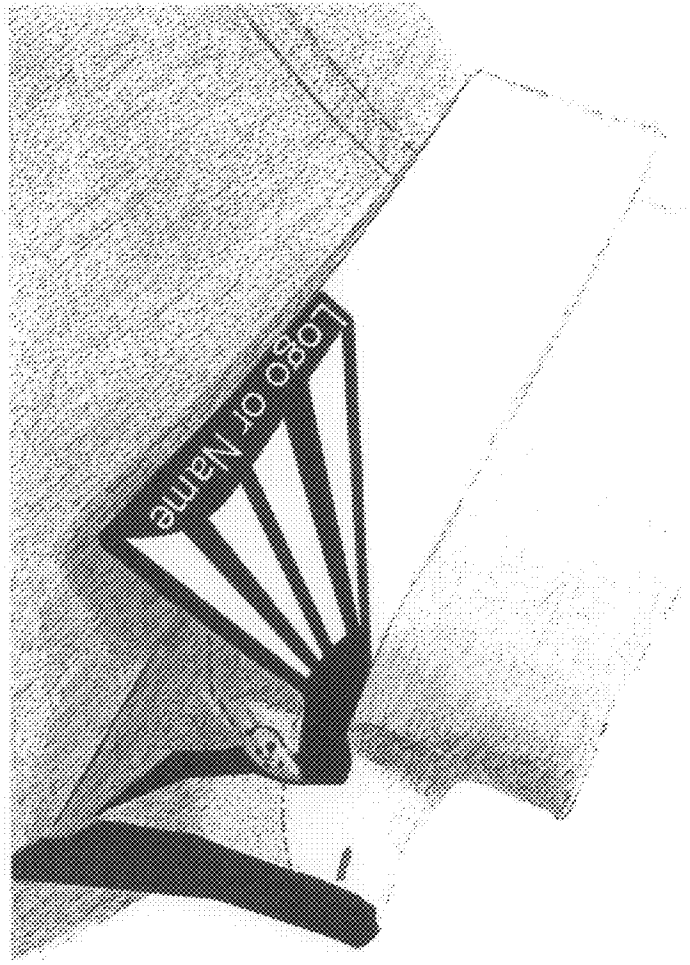
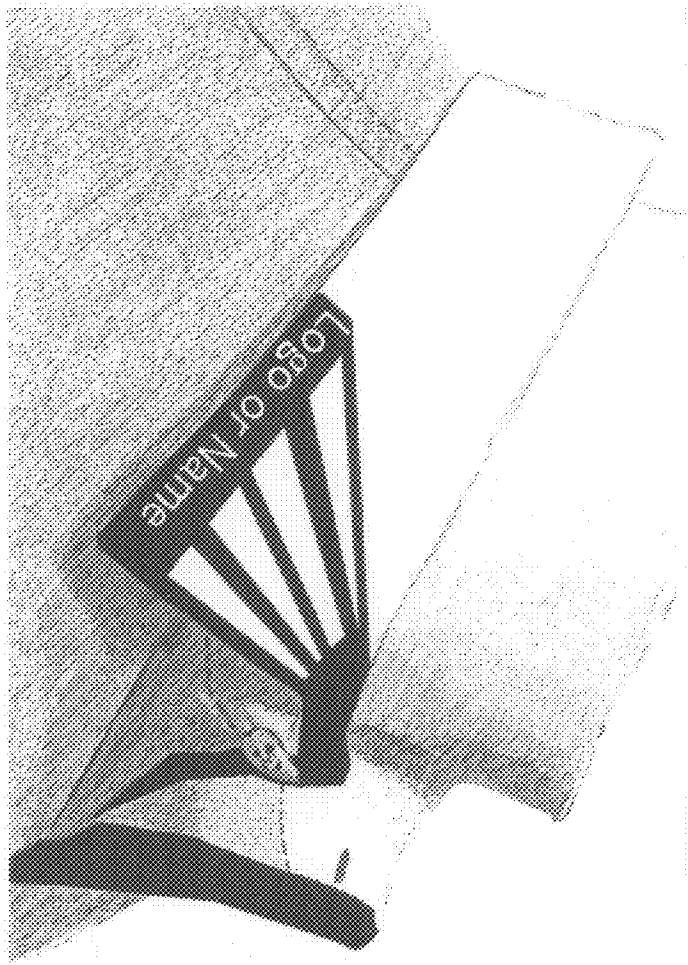
Figure 25

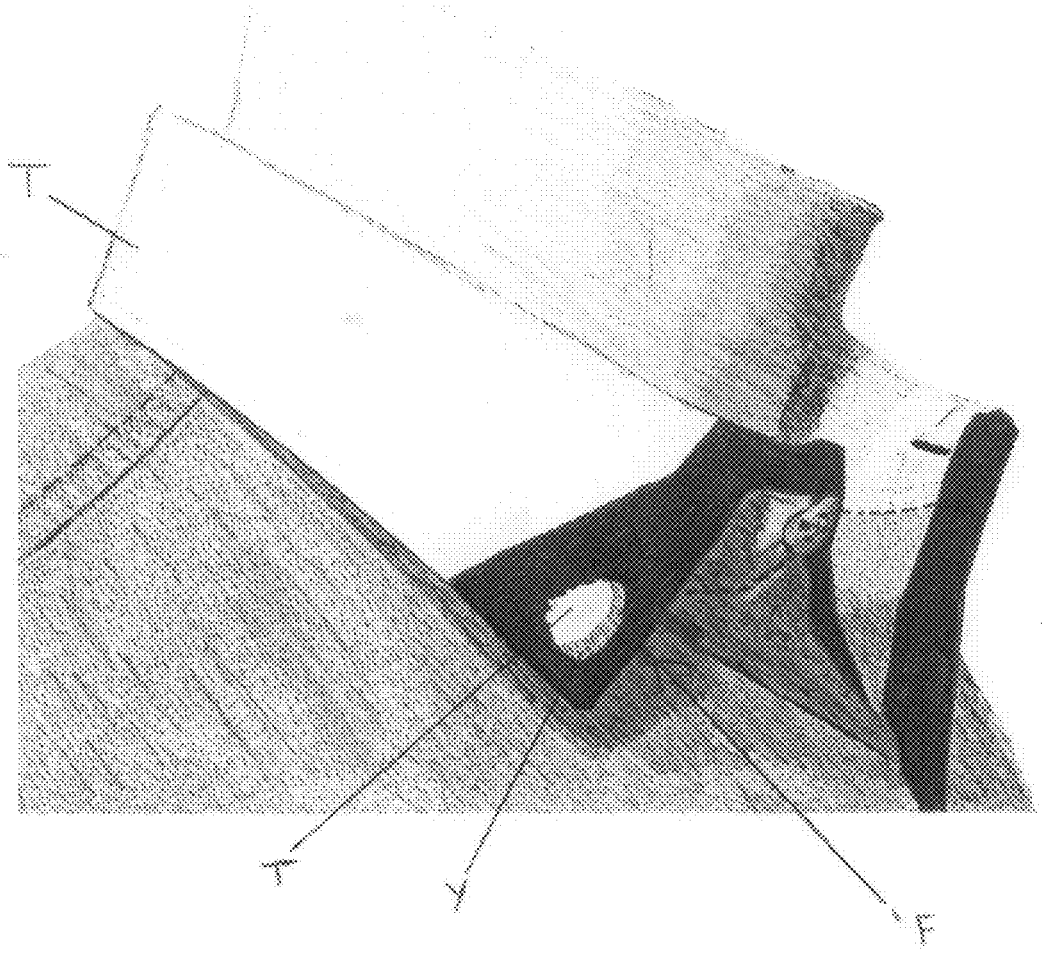
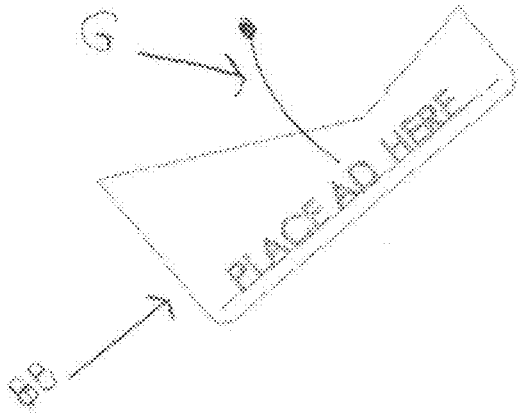
Figure 27

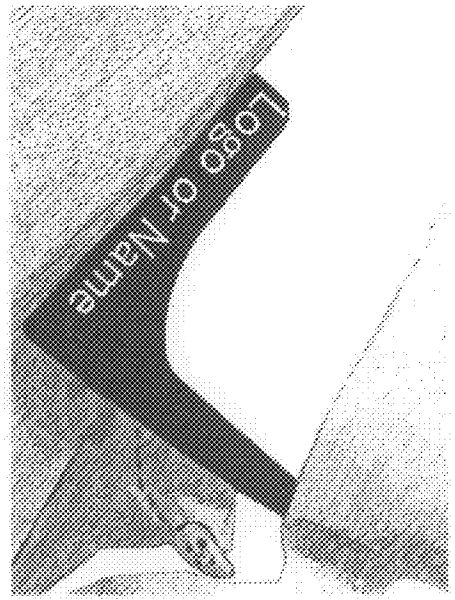
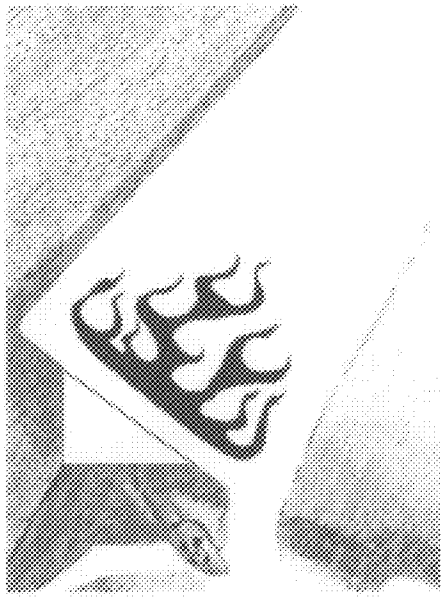
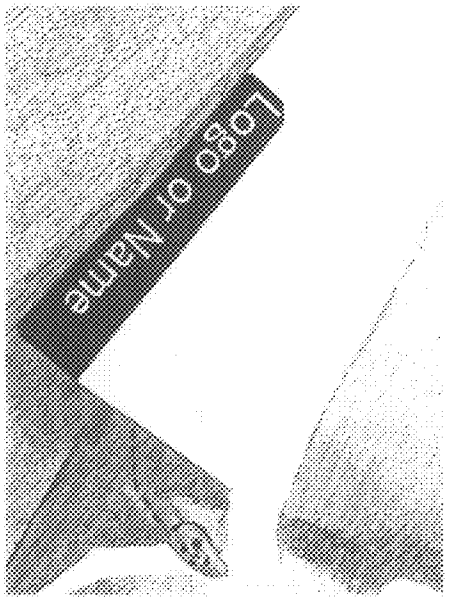
Figure 28

FASHION AND FUNCTIONAL GARMENT STAYS

CROSS-REFERENCE TO RELATED APPLICATIONS

This application claims the benefit of U.S. Provisional Application No. 61/848,170, filed Dec. 26, 2012, which is hereby incorporated by reference in its entirety. Although incorporated by reference in its entirety, no arguments or disclaimers made in the parent application apply to this divisional application. Any disclaimer that may have occurred during the prosecution of the above-referenced application is hereby expressly rescinded.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

The field of the invention is garments, or more specifically, garment attachments.

(2) Description of Related Art including Information Disclosed under 37 CFR 1.97 and 1.98

U.S. Pat. No. 8,001,619 to Baehring, discloses a Lapel Stiffener that is to be sewn to the inner side of a lapel, placed in pocket that is sewn on the inner side of a lapel, or placed behind the lapel of a garment by use of an adhesive. This style of device does not allow the abilities or function (the different shapes of stays, types of stays, sizes, placement, and usage), as described within the present invention. In addition an external stay of any type is not mentioned in Baehring. Style options such as specific shapes and colors are not achievable through Baehring's invention as taught by the claims, artwork, and specification of the current invention.

There is continuing need for new solutions to solve the following problems associated with garments:

1) A solution to the collapsing collar on a buttoned shirt caused when the first button at the collar section of a garment is unbuttoned. This usually causes one or both of the sides below the first button (the plackets), to crease, bend, flip-out, or fall usually uneven to its opposite side.
2) A way to shape the upper placket or upper placket and collar of a buttoned shirt, blouse, or partially buttoned shirt (polo style shirt or upper buttoned style shirt), for a particular style that the original garment doesn't offer.
3) A solution to shaping a garments collar that cannot be achieved by traditional type collar stays.
4) A means of adding interchangeable patterns and color options, a logo or logos, different shapes, design theme or similar to the collar of garments, the area below the collar along the folded edge of either or both plackets, for a specific look or style.
5) A solution to the bulge, gap or opening between the closure elements of buttoned styled shirts for the many styles of plackets that different brands use.
6) A solution to changing the shape of the collar, and/or the area below the collar of zip-up-style jackets or coats, buttoned jackets or coats, and other garments.
7) A solution to changing the shape of the collar on jackets, blazers, or coats that cramp, touch or rub against the wearers neck. A solution to this problem could reduce material wear of the inner collar, reduce stains from rubbing against the user's skin, or even reduce restricted head movement caused by the length of the collar and/or position of the collar against the wearer's neck.
8) A solution to the unwanted crease in the lapel of a blazer, sport coat or suit around the chest area of some people (a bend in the material often caused by men that are barrel-chested or women who's chest causes a crease in the lapel). Many sales professionals have a hard time selling a garment that overly creases there, therefore a solution is needed.

The instant garment devices provide solutions to all the problems mentioned above and offer limitless potential of style options that do not currently exist.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The invention may seek to satisfy one or more of the above-mentioned desires. Although the present invention may obviate one or more of the above-mentioned desires, it should be understood that some aspects of the invention might not necessarily obviate them.

BRIEF SUMMARY OF THE INVENTION

The present invention provides the wearer of different garments (polo-shirts, buttoned shirts, jackets, sweaters, high collared coats, blazers, suits, and the like which use buttons, a zipper closure or both), different functional wardrobe options, style, and solutions to current problems with garments. that does not exist in the market.

The various embodiments include an internal stay that is suitable to detachably attach to a garment in the collar, or placket region. The garment may or may not need modification. Preferably, the garment is an off-the-shelf garment requiring no additional modification to receive these stays. Further, the stays can have various configurations to facilitate insertion and usage. Further, the internal stays can work with external stays such that external stays are visible from the outside so as to show a message, a slogan, a style, a logo (e.g., a sports team logo).

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

It should be noted that the drawing figures may be in simplified form and might not be to precise scale. In reference to the disclosure herein, for purposes of convenience and clarity only, directional terms, such as, top, bottom, left, right, up, down, over, above, below, beneath, rear, front, distal, and proximal are used with respect to the accompanying drawings. Such directional terms should not be construed to limit the scope of the invention in any manner.

The present invention will become more fully understood from the detailed description given herein below and the accompanying drawings which are given by way of illustration only, and thus, are not limits of the present invention, and wherein:

FIG. 20 shows a shirt with a drooping fold in the upper region of the placket area as a result of no garment stay. Below that illustration is a perspective view of a person wearing a shirt and jacket showing the shirt with shape to the upper region of the placket due to the use of an embodiment of garment stays.

FIG. 21 shows perspective views of two further embodiments. The top figure shows how an external stay can follow the outer placket of a button shirt and continue onto the collar. A second illustration shows how the external stay of the placket can function in conjunction with the external stay of the collar, while the two stays are physically separate and unconnected.

FIG. 25 is an embodiment similar to that shown in FIG. 24, but shows how a name or logo can be showcased on portion of the external stay on the shirts collar.

FIG. 27 is a perspective view of a button shirt which shows an external collar stay covering the placket region and collar. In the collar region, it shows the collar, magnet from the underside of the collar in relation to the external collar stay. A second drawing shows an external collar stay with advertisement space.

FIG. 28 is a perspective view of different examples of external collar stays

DETAILED DESCRIPTION OF THE INVENTION

Figure 1:
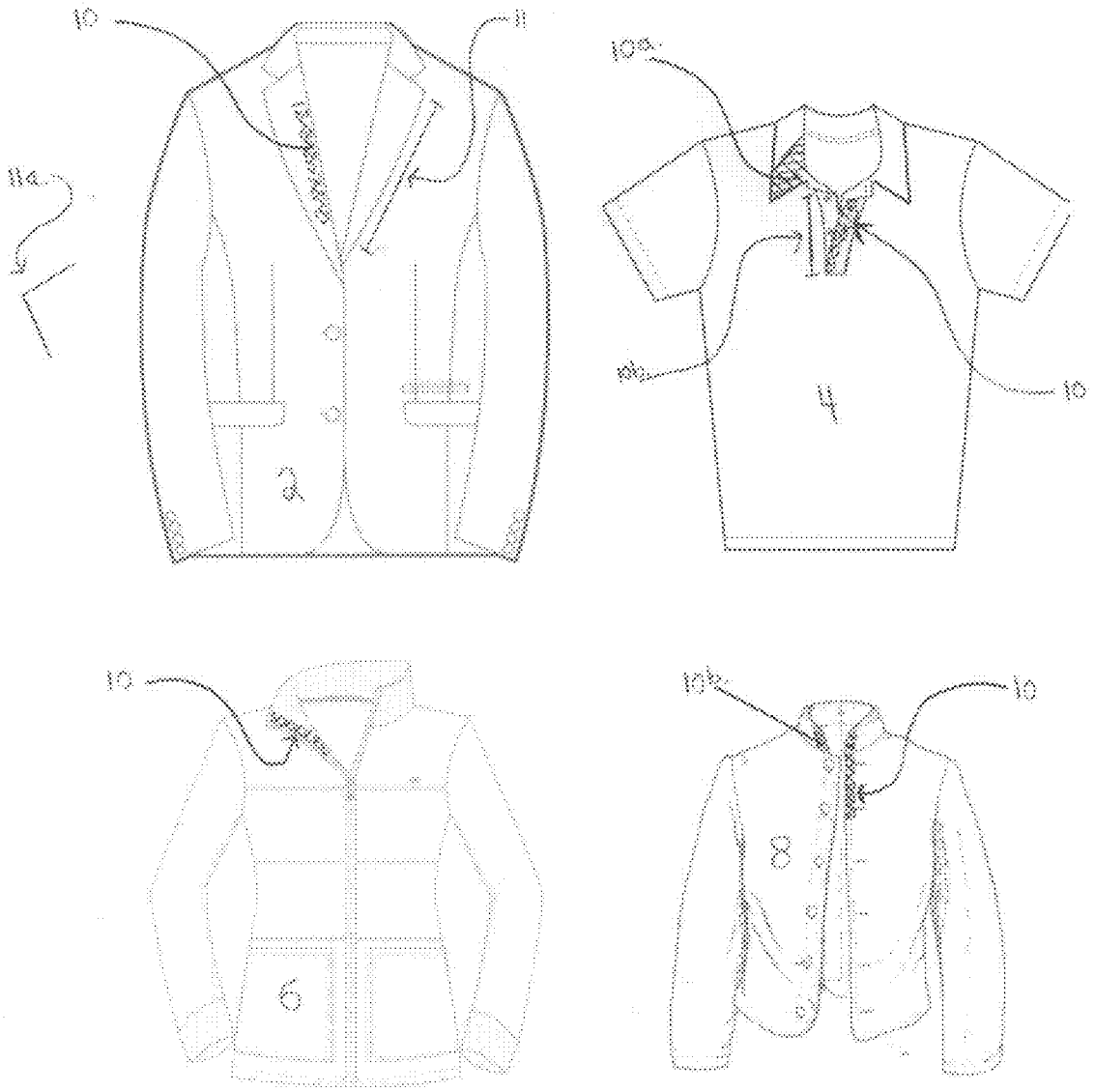
FIG. 1 is a perspective view of a suit blazer, polo shirt, high-collar zipper coat, and a high-collar jacket; each showing at least one region to receive a garment stay.

Referring now in more detail to the drawings, FIG. 1 illustrates a suit blazer 2, polo shirt 4, high-collar zipper coat 6, and a high-collar jacket 8; each showing at least one region of shown shaded area 10, to receive a garment stay (either externally or internally). On suit blazer 2, the shaded area 10 is between a first or inner front panel of the lapel and the outer front face of the garment. The type of stay used here is contemplated to be be 4"-12" in length, flat, but bendable enough to provide a user-shapeable contour with the garment (yet retain its shape), and made from ferrous or non-ferrous materials. This particular embodiment of stay would not require a button or button hole catch (as will be described later), and would be received by an internal compartment on the top, inner side of both lapels in region 11. The purpose of this stay is to reduce the crease in the outer, vertical front surface of the lapel caused by its wearer if he or she is barrel-chested. This type of crease is unattractive to the wearer, causing a bend radius of 45 degrees or more, shown 11*a*, in the outer vertical surface of the material of the lapel region 11.

This same idea and method can be applied to various types of garment, whereby an internal compartment is specifically made to receive some type of stay. This internal compartment can be located in various regions of a garment as disclosed throughout this specification. Desirably, these are regions of a garment that typically cover the neck, chest, stomach, or a combination of these areas.

As illustrated in FIG. 1, the polo style shirt 4 could accept garment stay in regions 10 and 10*a*, with 10 being the placket region and 10*a* being the collar region. The stay used in the placket region would be an internal stay and received by an internal compartment on the top or side, of the inner side, of one or both plackets. The stay used here could be flat to retain a flat appearance in the outer vertical placket region 10*b*, or could be shaped with a curve or curve and twist in the body of the stay so that the upper placket region faces up and away from the wearers chest for a different appearance that said original garment would not provide. The stay used in 10*a*, would be an external stay offering a bend radius, style, and color option that could transform the appearance of the polo, ultimately changing its look and style. The external stay 10*a* could come in a variety of colors or finishes and could be made from ferrous or non-ferrous materials.

In FIG. 1, high-collared zipper jacket 6 could receive a stay in placket region 10. The stay used here could be a received in ways similar to one described for suit blazer 2 above, but could also be received from the inner side of the placket region. In one embodiment, the stay is different from the stay used in suit blazer 2, for the purpose of shaping the placket region and collar of the coat when it is un-zipped. Men and women who have a shorter neck length often find the collar of high collared jackets, sweaters, and coats to be troublesome. The collar may hinder movement of the head, rub against the neck of the wearer, and can cause soiling or wearing of the inner material on the collar due to constant contact with the wearer's neck. For men, facial hair and neck hair can cause fraying of the material on inner collar. A stay used in this type of garment can allow the wearer to select from different shapes of stays, offering a selection of a different bend radius for function and added style to a high collar. In addition to shaped stays, a pliable, bendable, stay could be an option so the wearer can shape the collar to his or her preference for style and function.

For pliable, bendable stays of the contemplated embodiments, these types of stays can be shaped by a user simply by hand when the stay is inside of the garment. As will be described throughout the specification, preferred embodiments are stays that can be detachably attached to the garment without additional modification to the garment. In some embodiment, the garment would require specific stitching, or modification (e.g., creating of a compartment), in order to receive the stays.

While some of the embodiments within this specification will describe how and where the stay is inserted into a region of the garment, other embodiments may not describe in such detail. One skilled in the art should immediately recognize that the method of insertion, the location of opening, and size and shape of the compartment, can be interchangeably used in most embodiments.

The high collar buttoned jacket 8, in FIG. 1 is functionally similar to zipper high-collar coat 6, the use of a stay is similar as well. The only difference here is that a shorter stay could be used in the upper collar region 10*b*, which could be received similarly (internal compartment in the garment, capable of receiving said stay to pass there through, on the top or side of the inner side of the placket region).

Figure 2:
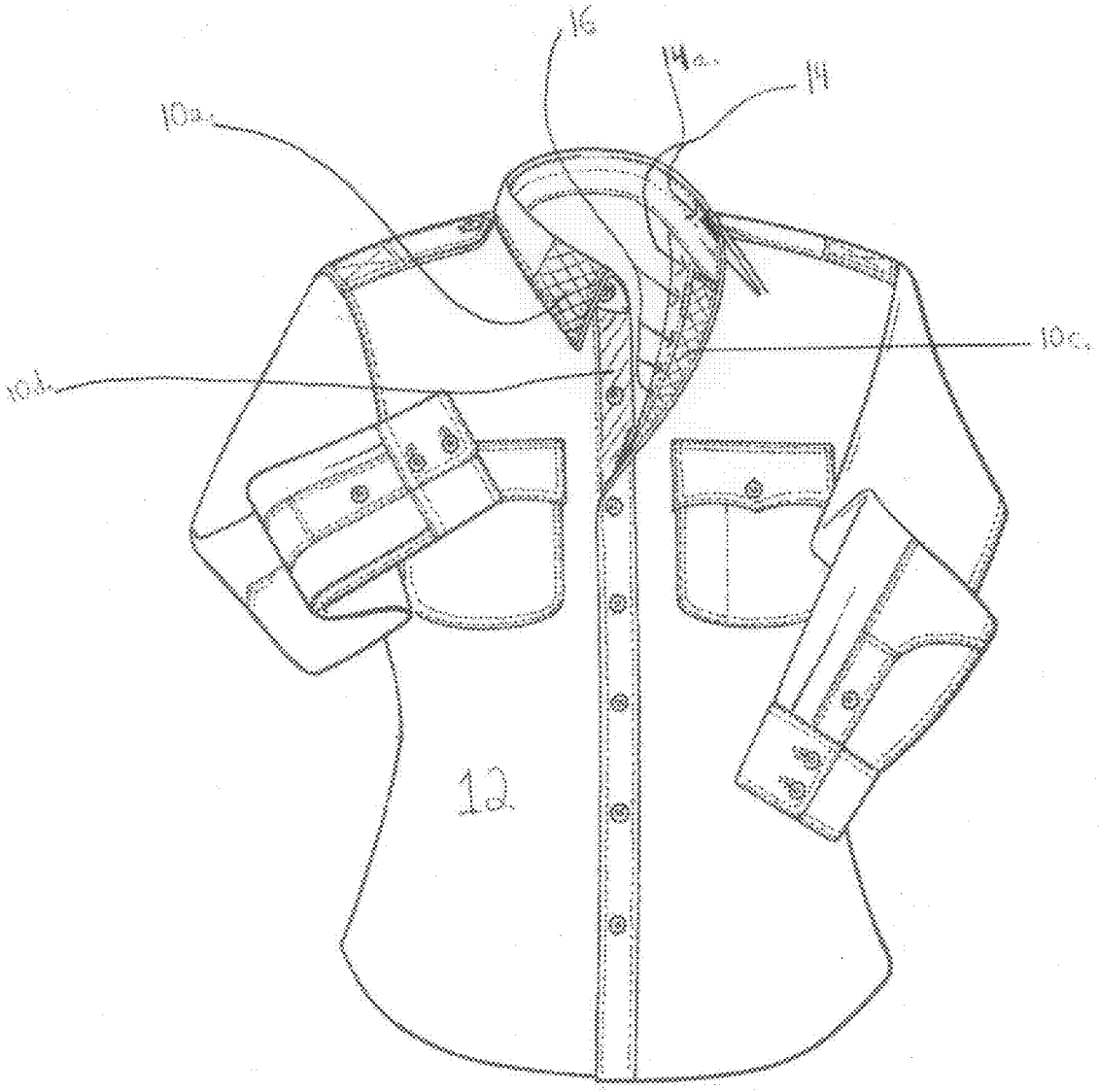
FIG. 2 is a perspective view of a button shirt showing regions to receive a garment stay and two of the areas to insert a stay in said garment.

The embodiment of FIG. 2, shows a buttoned collar shirt 12 with placket regions 10*c*. and 10*d*. to receive a stay in the inner side 16, top of placket 14, or top of collar 14*a;* whereas, 10*c* is the inner side of the placket region, and 10*d*. is the outer side of said placket region. 10*a*, shows an external collar stay that can be received similar to polo shirt 4 in FIG. 1. The exact methods of receiving and retaining external collar stays will be described in more details below. An external collar stay, as is in the case of an external placket stay, is meant to be visible by others when they are fastened onto the garment.

Figure 3:
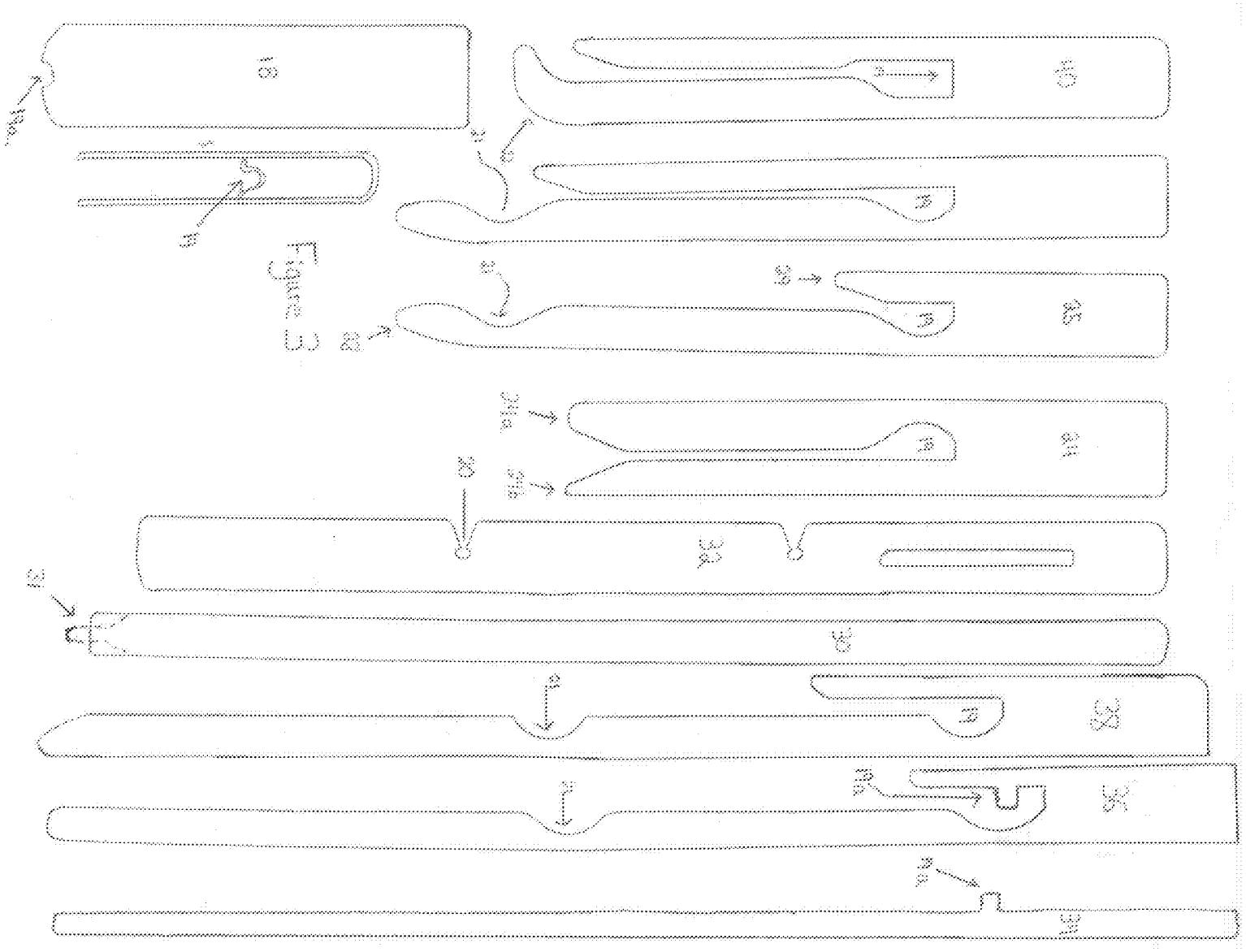
FIG. 3 are perspective drawings of various embodiments of garment stays that can go on the button-side placket or the button-hole side placket, or any region of any garment that does not use buttons.

The embodiment of FIG. 3, shows some of the different shapes of internal stays each with functional characteristics. Perspective drawing of stay 18 shows a main body with no appendages, with a button catch 19*a*. Numeral 19, references a button hole or button catch, whereas 20 illustrates a button holder. 21 shows a cutout in the material of an appendage for the purpose of allowing room (e.g., clearance area) to connect a button through a button hole, so as to minimize hindering of button and button holes. Numeral 22 shows the bottom of an appendage that is curved to allow easier entrance to the placket region of a garment when entering from the inner side. This is especially important because these stays are designed to be detachable from the garment before laundering. Specific curves (e.g., 22) allow easy entrance and navigating through the buttons or button holes in the placket. Specific catches (e.g., 19 and 19*a*) allows abutting engagement with a button or button hole, therefore no modification to the garment would be necessary to receive some of these embodiments of stays. Numeral 24 shows a stay with a main body followed by two appendages 24*a*, 24*b* of equal length, whose appendage 24*a* is wider than appendage 24*b*, with appendage 24*a* and 24*b* being cut at an angle on the inner side of the end of the stay to allow easier insertion when being received in said internal compartment of said garment. Stay 24 has appendages of different width because the area between the button or button hole and the inner and outer side of the vertical edge of the placket are different widths. As for stay 25, it has one long appendage 28, and a shorter appendage 29, and a button or button hole catch 19. Stay 30, can be inserted from the top of the placket or collar of a garment. Stay 30, has a built in clasp 31, to be used when inserting from the bottom of an opening through an internal compartment of a placket region. Stay 32, can only be inserted from an opening in the inner side of a garment placket that has a folded crease (one that is not sewn). Stay 34 is a thin stay and has a button catch 19*a* that is positioned to keep the stay in a specific location of the garments placket. The length of the body above and below the button catch 19*a*, plays a role on the function of the stay. For example, if the stay is received from an opening in the top, inner side of the placket just below the first button, and button catch 19*a* is located near the top of the stay, the stay will not extend past the height of the second button. Stay 36, has a main body with one appendage being longer than the other. It also references a button catch 19*a*, with cutout 21, to allow more room when connecting the button and button hole. Stay 40, would be received into the placket region from the side of the garment and the longer curved 22 portion at the end of the appendage allows it to be received easier into the internal compartment of the placket region.

Figure 4:
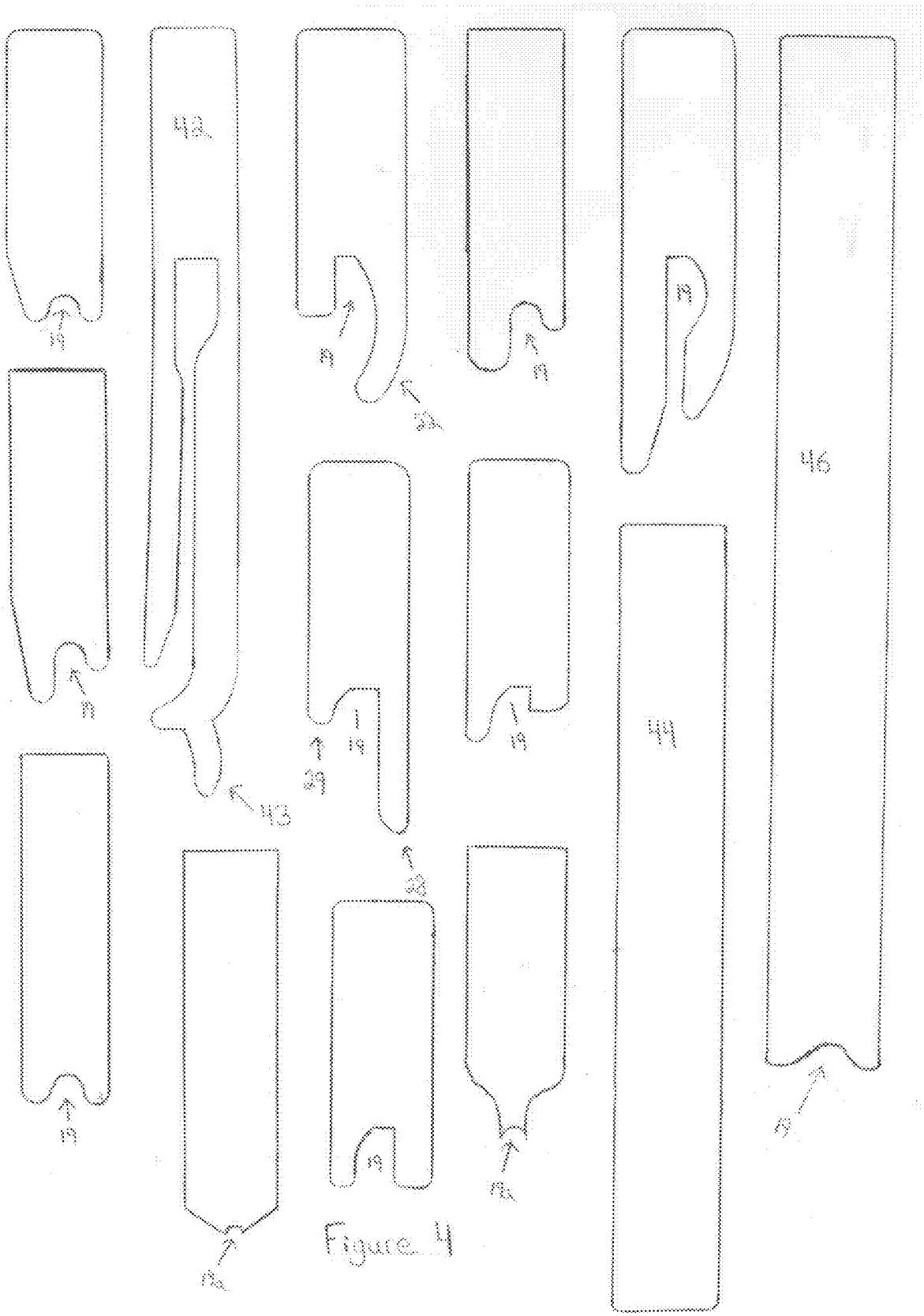
FIG. 4 are perspective drawings of additional embodiments of garment stays that can go on the button-side placket or the button-hole side placket, or any region of any garment that does not use buttons.

The embodiment of FIG. 4, shows other examples of stays that offer different characteristics. For example, 42 shows a stay with a hook 43 that keeps the stay positioned between the button, the folded or sewn outer edge of a placket, and a folded inner edge of a placket that has no seam stitching down its vertical face; this keeps the stay from coming out of the side of the opened inner side of the placket. Stay 44 can be used in the placket region with any of the garments. This style of stay is especially useful for jackets, suit blazers, coats, and buttoned shirts that do not have a top button or button hole or do not have a second button or button hole. Stay 46 allows it to fit similarly like stay 44, but may be more ideal to be used with a buttoned shirt as it contains button or button hole catch 19.

All of the stays shown in FIG. 3 and FIG. 4 represent stays that are internally accepted in an opening inside the placket region of a garment. These stays can be ferrous, non-ferrous, plastic, carbon fiber, titanium, aluminum, mild steel that is bendable, spring steel that retains shape, heat treated to retain shape, anodized a color, chromed, powder coated, plated or painted to protect the stay from oxidation or rust if it's ferrous. These stays can be soft, flexible, bendable, rigid, or come in a variety of bends in the structure of the stay to allow for different shapes in the placket or placket and collar region of a garment that the original garment could not achieve.

Figure 5:
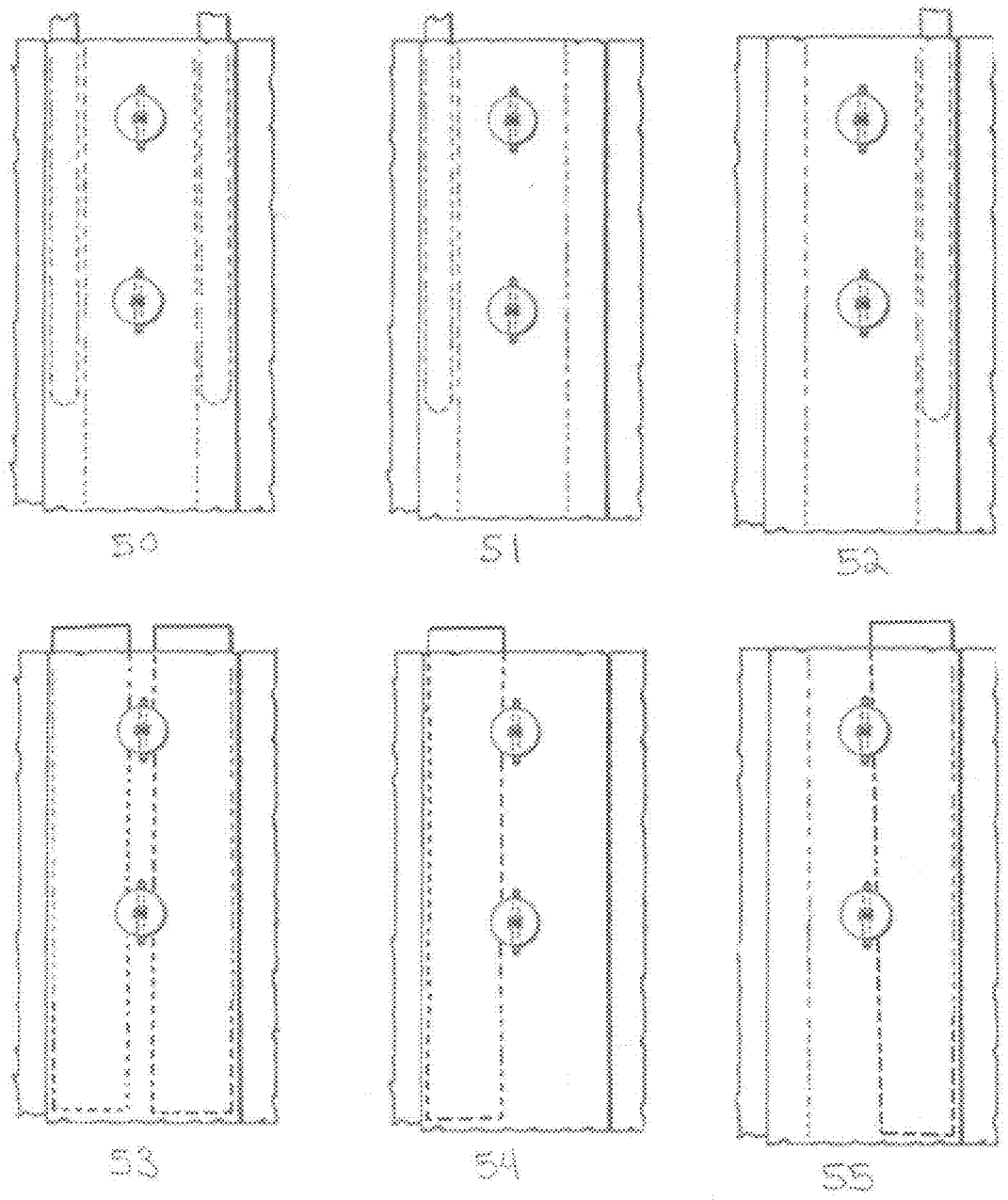
FIG. 5 shows some of the different front plackets of buttoned shirts, how the width between the button or button hole can differ from the inner and outer edge of the placket, showing different arrangements of stays to be used in the over-lapping placket. Here, various embodiments are shown where two garment stays are in place for a single placket; the two stays each can have various widths, and the placket can have especially sewn compartment with a width to specifically fit such stays.

The embodiment of FIG. 5 shows some examples of different plackets and stay positions for a buttoned shirt. In embodiment 50, the placket region is sewn on the inner and outer side of the garment. There are two stays in the front overlapping placket. The stays would most easily enter the garment along the vertical axis of the placket (from the top to the bottom depending on where the stay is to be positioned within the placket of said garment).

Embodiment 51 is similar to 50, but shows a stay on the inner right side of a placket, whereas, embodiment 52 shows the opposite. In embodiment 53 the placket is folded on the inner and outer edge, there is no stitching down the vertical face of the placket. In this embodiment, the stays are positioned between the button hole or button and the inner and outer fold in the plackets material. In embodiment 54, one stay is used in one side of the front placket; there is no stitching down the vertical face of the placket like in 53. Lastly, embodiment 55 shows a front placket with a folded edge having a stay received, with the opposite side of the placket being stitched down the vertical face of the placket.

In the embodiments as shown in FIG. 5, the two stays can or cannot be tethered to each other.

Figure 6:
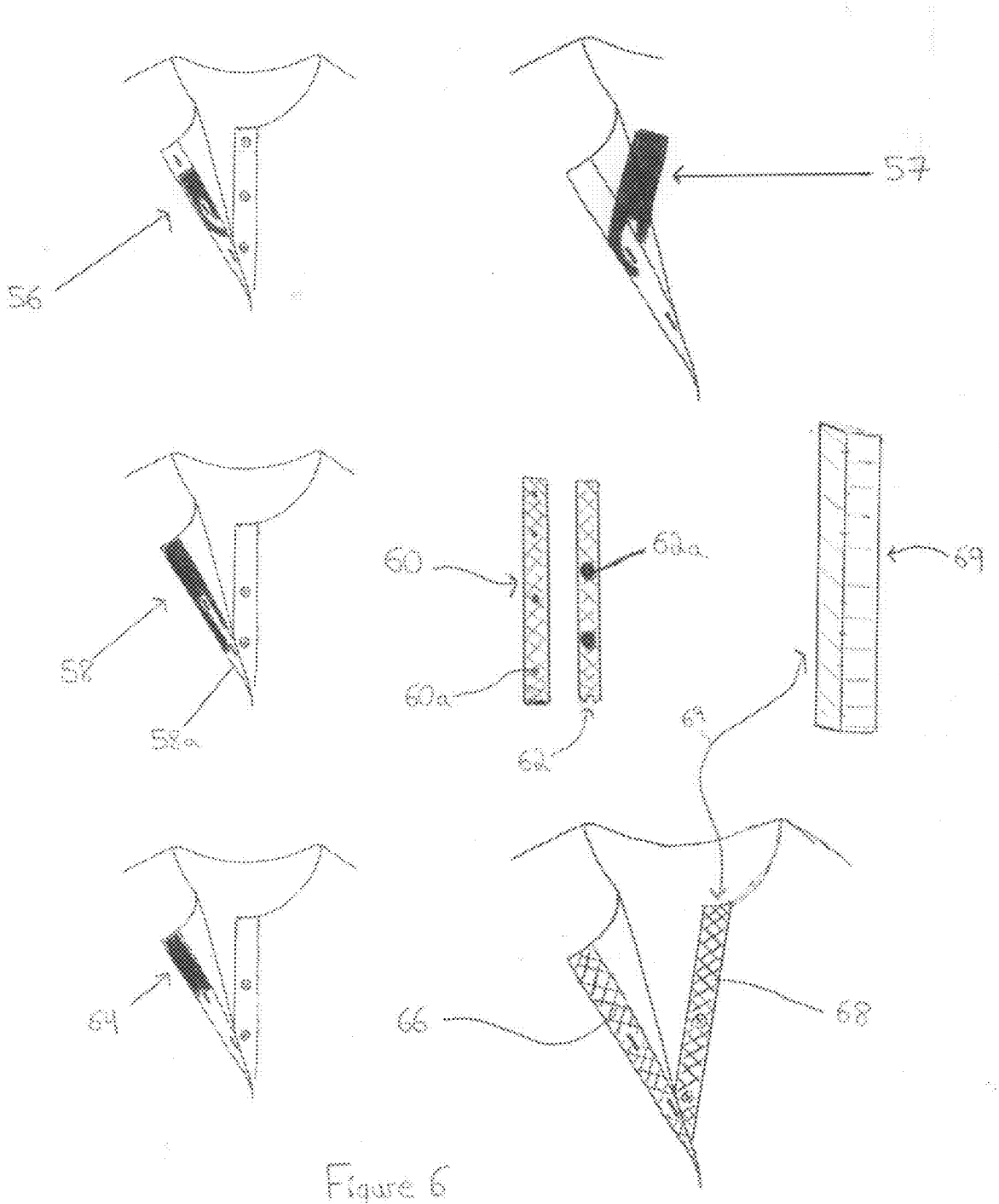
FIG. 6 shows a button shirt or polo shirt example with different styles of stays inside the placket region. The top two examples show how a stay may be inserted from the inner placket inner side of a shirt. Two examples in this figure illustrate yet another embodiment where a garment stay that can cover the front and back side of a placket.

In FIG. 6, embodiment 56 shows a shorter internal stay in the placket region of a buttoned shirt. One way to insert the stay into the placket region is shown by arrow 57. Arrow 58 shows a slightly longer internal stay than that shown in arrow 56, with a longer appendage shown on the outer edge of the placket fold 58*a*. Embodiment 60 shows an external stay which connects to the inner side of a garments placket, which can fasten to an outer external stay 62 by the use of magnets 60*a*. Outer external stay 62 offers holes 62*a* which can fit over the buttons on the outside of a garments placket. Embodiment 64 shows an internal stay received in the internal compartment of a shirts placket. In 64, there is no top button or button hole so the stay can connect further up onto the collar. This may allow for control of the shape of the placket and collar. Embodiment 66 shows the inner side of the placket region featuring an external stay. This stay can come in different shapes, materials, and colors, similar to the inner stays in FIGS. 3 and 4. Embodiment 68 shows an external stay on the outer side a garments placket. Lastly, 69 shows an external stay that is folded to fit over a garments placket as shown in 68.

Figure 7:
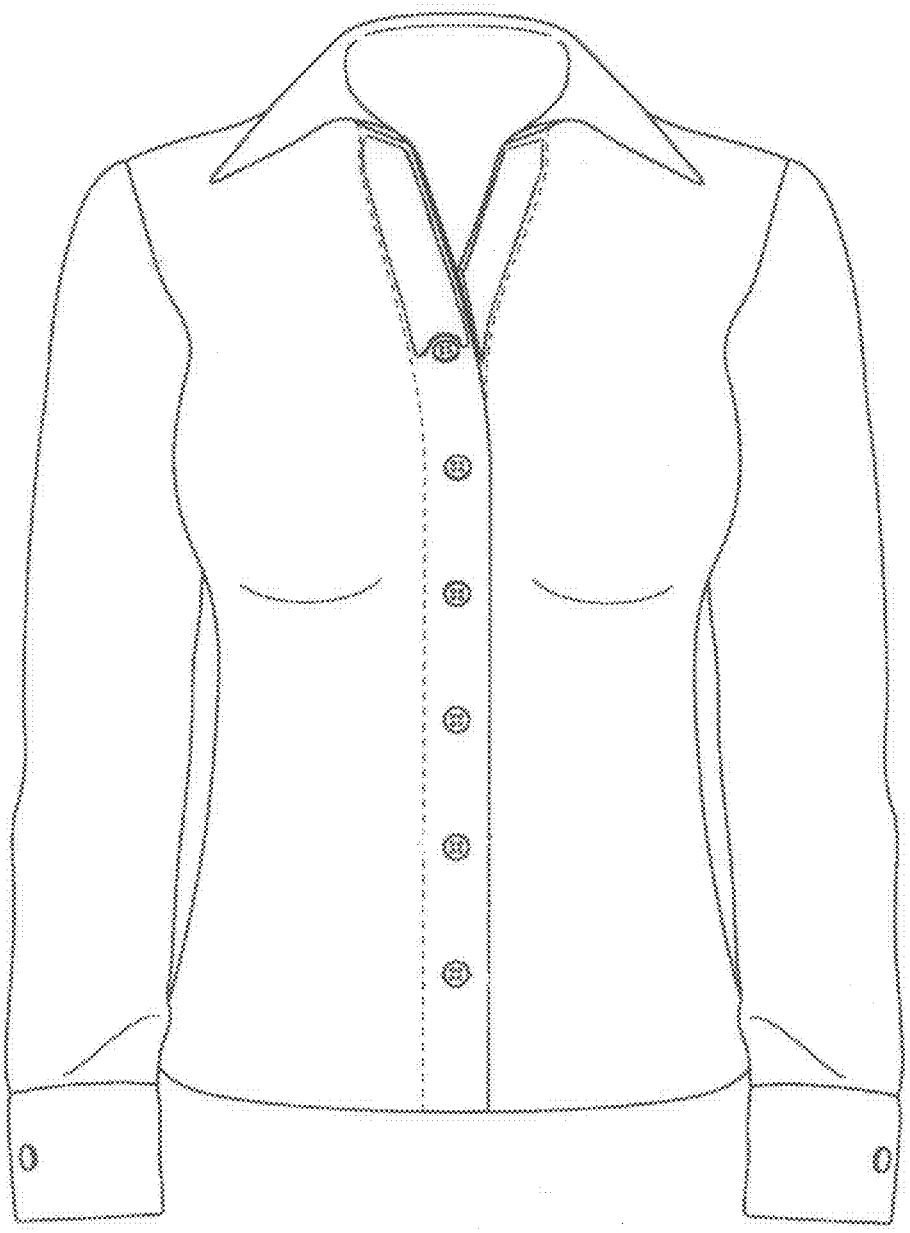
FIG. 7 is a perspective view of a button shirt with one embodiment of the garment stay in the upper region of the placket.

FIG. 7, shows a shorter stay in the placket region for the left and right placket of a buttoned shirt. This particular embodiment of stay offers no appendages, has a button or button hole catch. This stay could be flat, semi-rigid-, rigid, or come in shapes to allow the stay to bend away from the wears body for a desired shape to the placket and collar region of a shirt.

Figure 8:
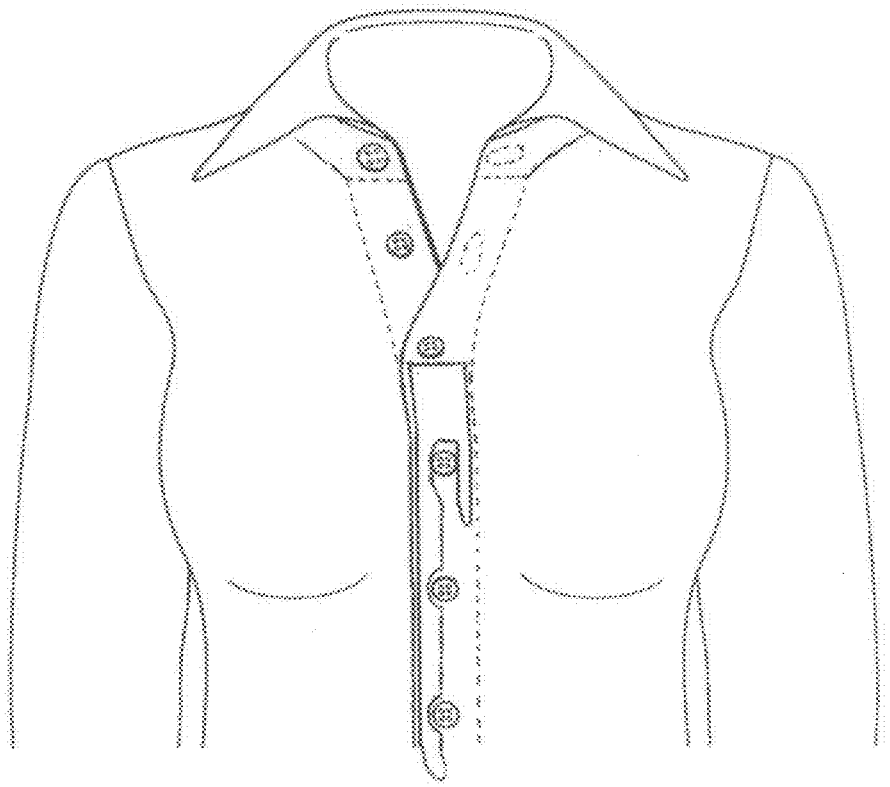
FIG. 8 shows a perspective view of a button shirt with yet another embodiment of the garment stay in the middle region of the placket.

FIG. 8, shows an embodiment of a button shirt with the stay being positioned in the mid-section of the placket region. This internal stay offers a main body, a button or button hole catch, with one appendage of longer length being on the outer folded side of the placket. This stay may be particularly useful in keeping the mid section part of the placket flat, further keeping the space between the button holes from puckering or opening.

Figure 9:
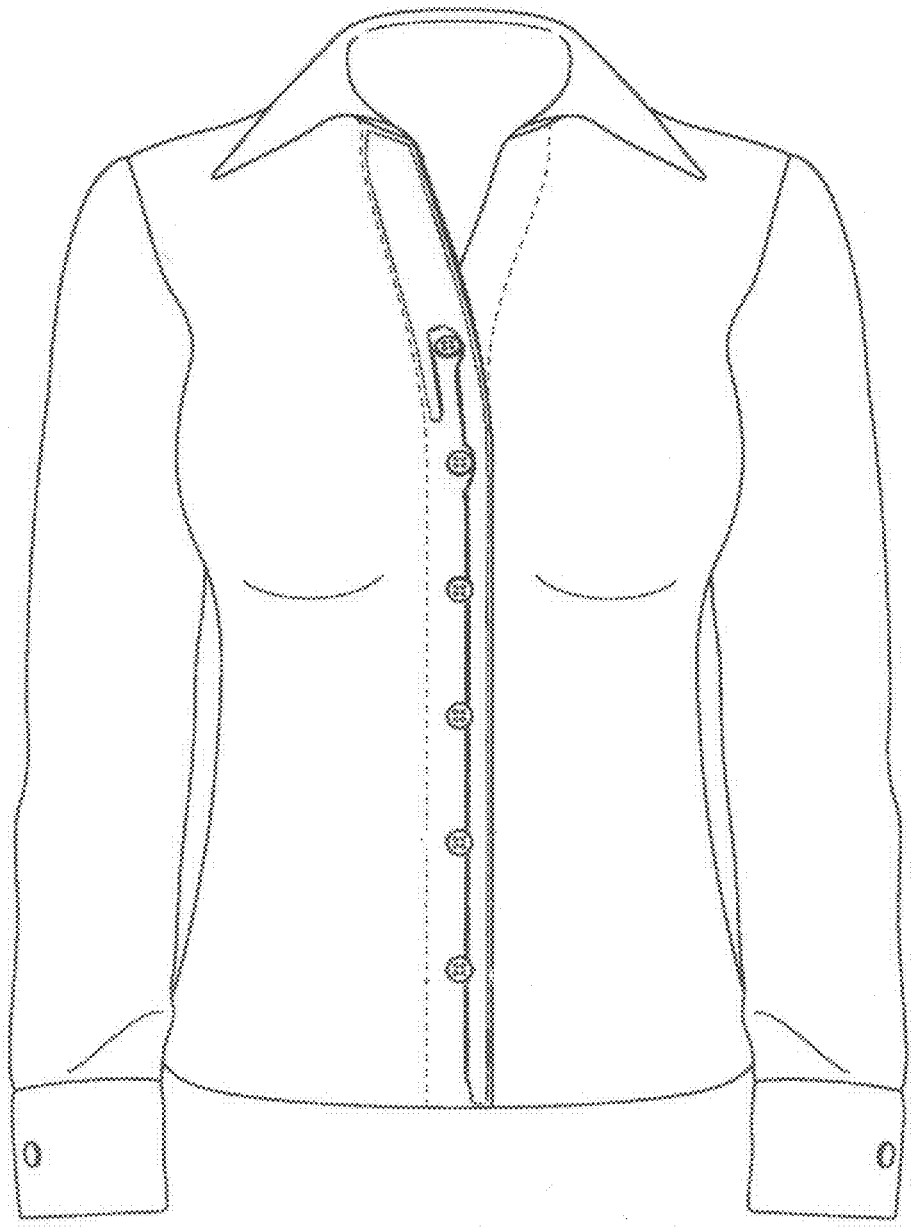
FIG. 9 shows a perspective view of a button shirt with another embodiment of the garment stay disposed in the full length of the placket.

In FIG. 9, a buttoned shirt has an internal stay featuring a main body, a catch, and one appendage that continues the full length of the placket region. This stay may be particularly useful in keeping the complete placket region below the main body flat, further keeping the space between the button holes from puckering or opening. However, the main body allows this stay to be offered in different shapes near the top of the placket region as any stay featuring a main body or main body and appendages can allow the placket region of a garment to hold a better shape due to more surface area and contact between the stay and the material encasing the stay. In addition, the main body of this stay may be a different material then its appendages; further allowing the main body to be shaped or rigid while its appendages are made of softer material or more flexible to move with the shapeable contours of the fabric of the garment.

Figure 10:
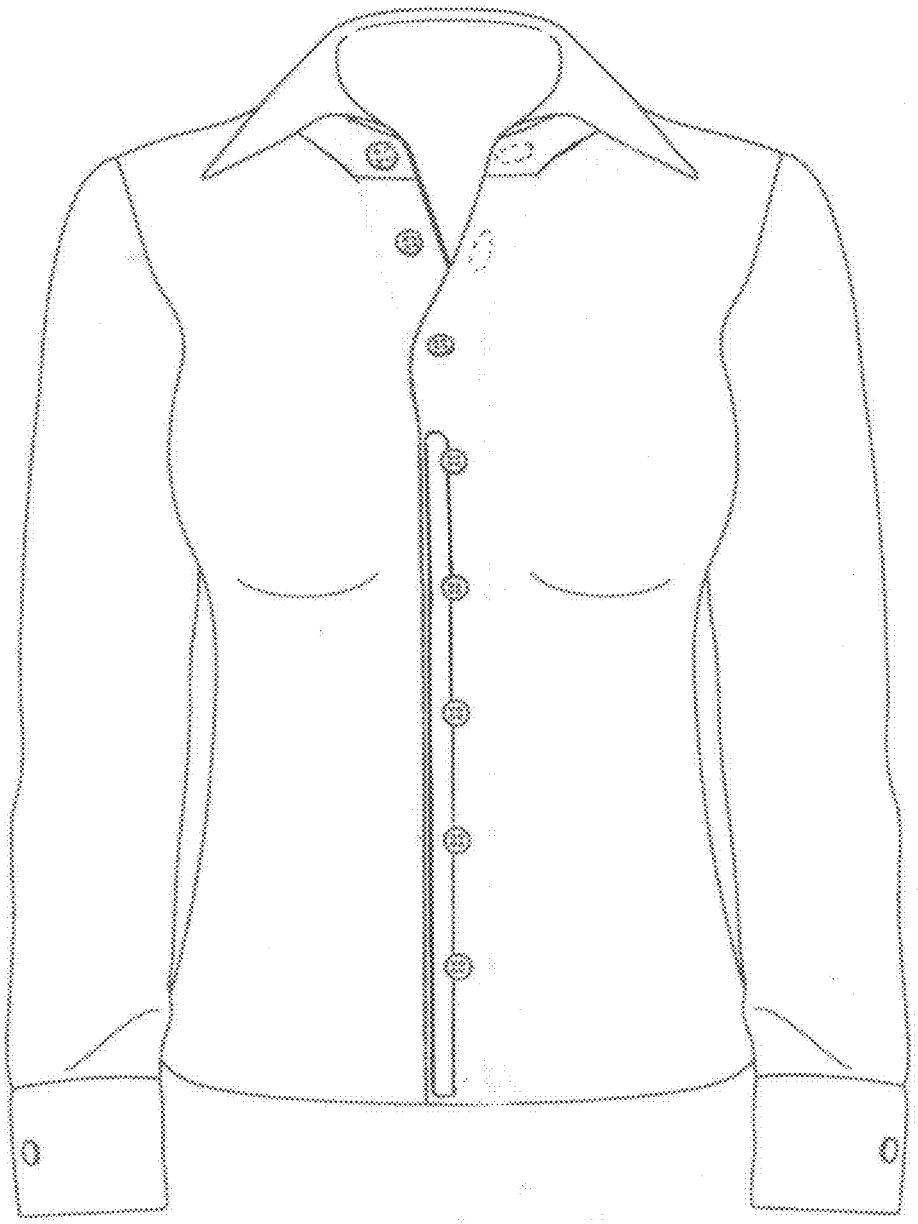
FIG. 10 shows a perspective view of another embodiment where a button shirt has a single stay in the lower ¾ of the length of the shirt.

FIG. 10 shows an embodiment of a buttoned shirt wherein the stay (not visible from the outside) is positioned inside of the placket between the folded edge and the button or button hole.

Figure 11:
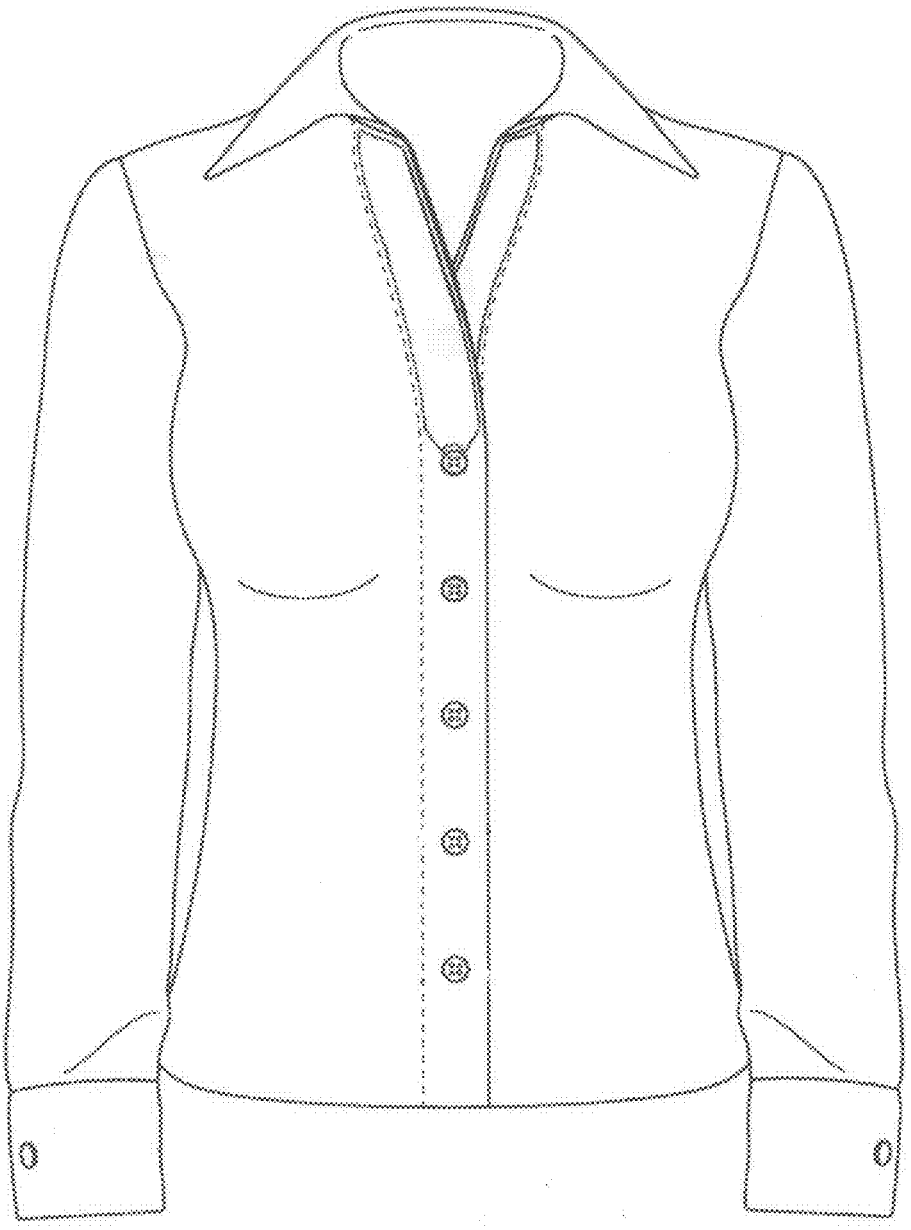
FIG. 11 shows a perspective view of a button shirt with a stay in the upper region of the placket, wherein this embodiment of stay has a catch at the bottom of the stay's main body that is v-shaped to allow easier fastening of the button and button hole. That is, the lower portion of the main body is contemplated to have certain shapes so as not the undesirably hinder fastening of the button when the stay is in place.

FIG. 11 shows and embodiment of a buttoned shirt wherein the internal stay features a main body with a v-shaped catch. The v-shaped catch offers more room and material around the bottom of the stay so the connection of button with button hole is easier to perform by the wearer.

Figure 12:
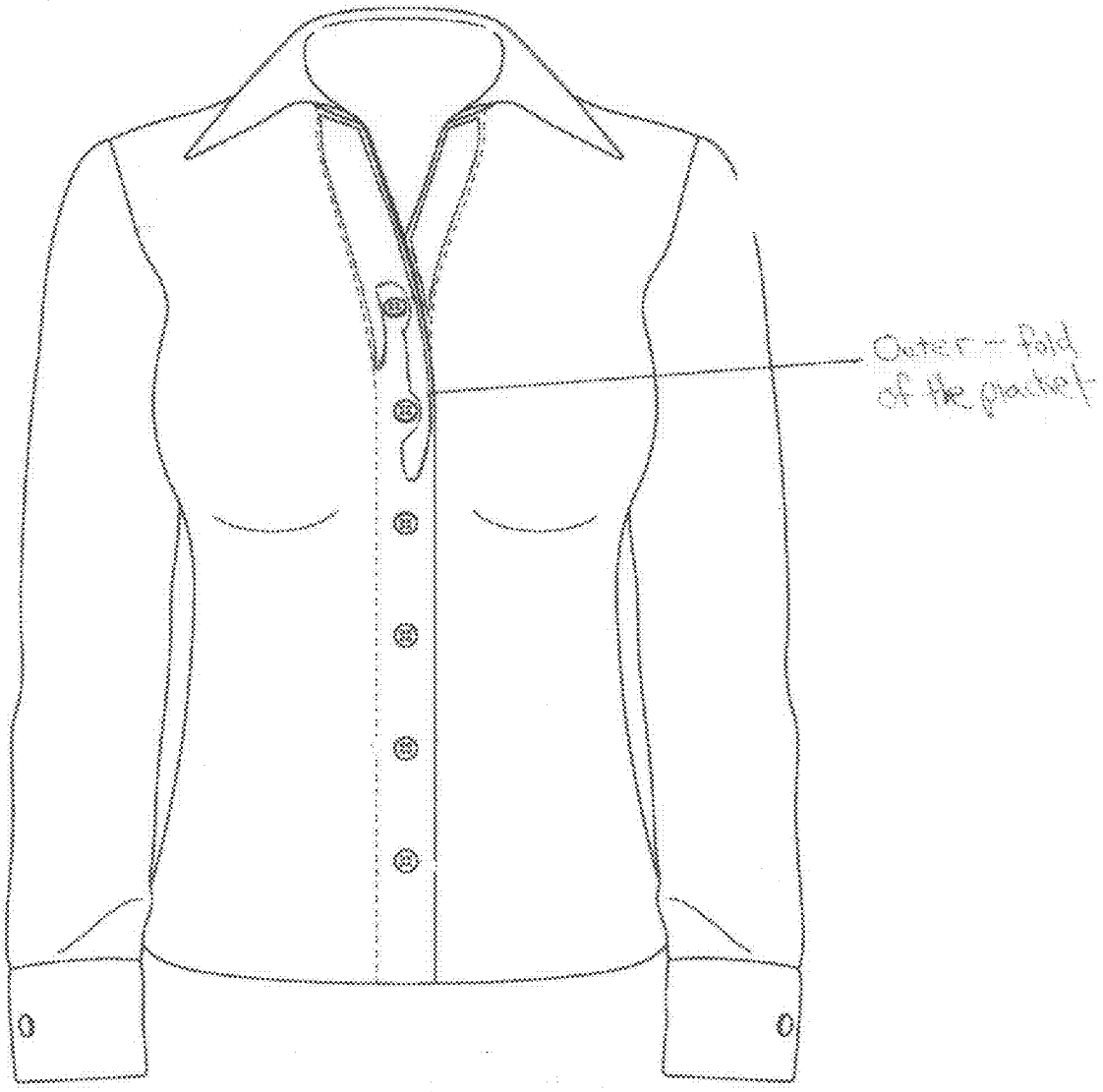
FIG. 12 shows a perspective view of another embodiment of the current invention, where a button shirt has a stay in the upper placket region of the shirt, and the stay has a lower appendage that is curved at the bottom of the appendage.

FIG. 12 features an embodiment of a buttoned shirt wherein the bottom of the stay's appendage is curved to follow the contour of the outer fold of the placket. This is especially helpful when the stay is longer or the button above it is unbuttoned. It also keeps the edge of the stay from poking into the fabric edge of the placket when the wearer moves freely.

Figure 13:
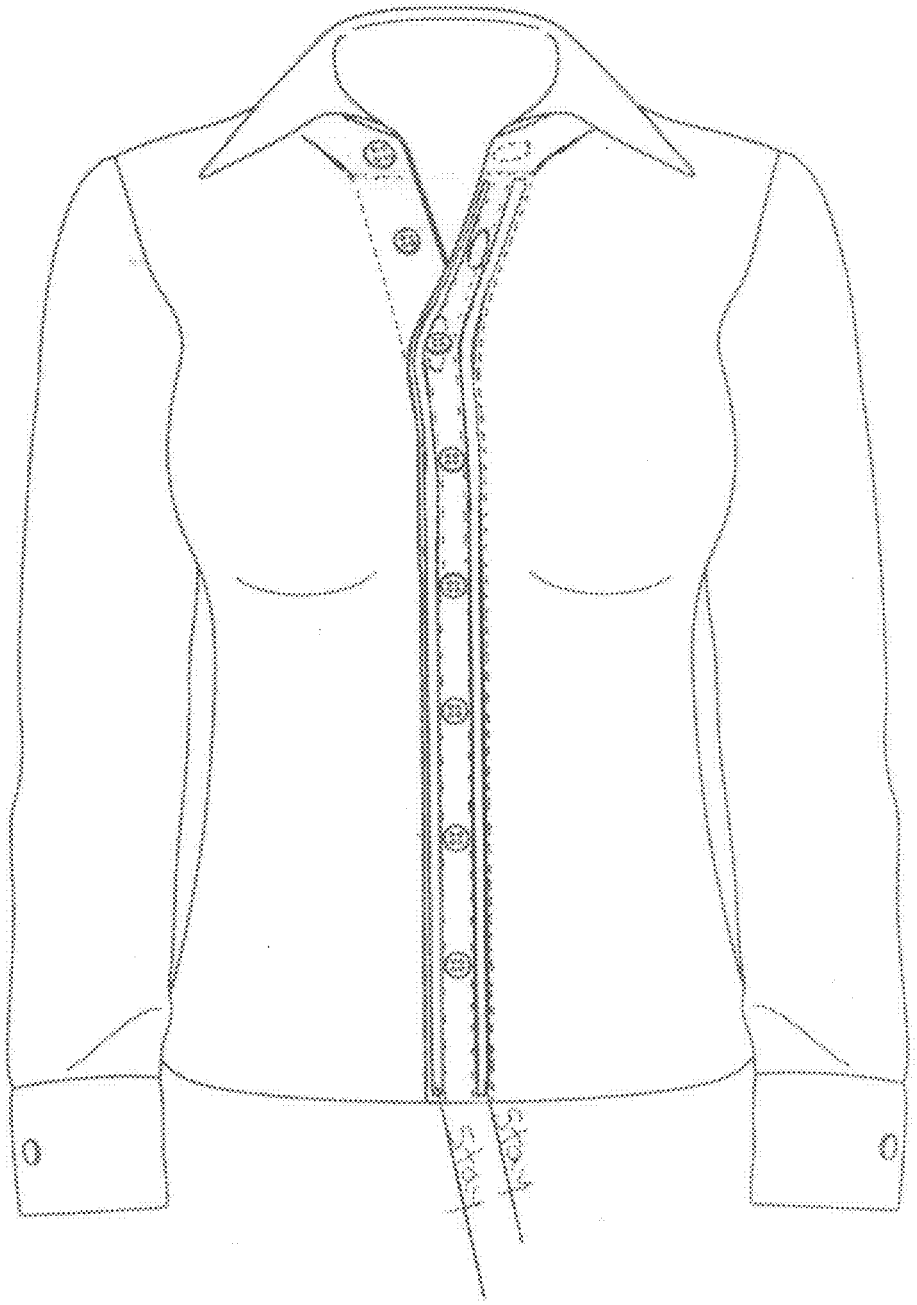
FIG. 13 shows a perspective view of another embodiment where a button shirt has two thin stays in a single placket, and the stays are positioned along the full length of the front placket of the shirt.

FIG. 13 shows an embodiment of a buttoned shirt wherein 2 independent stays are disposed inside the same front packet in parallel, for the full length of the shirt.

Figure 14:
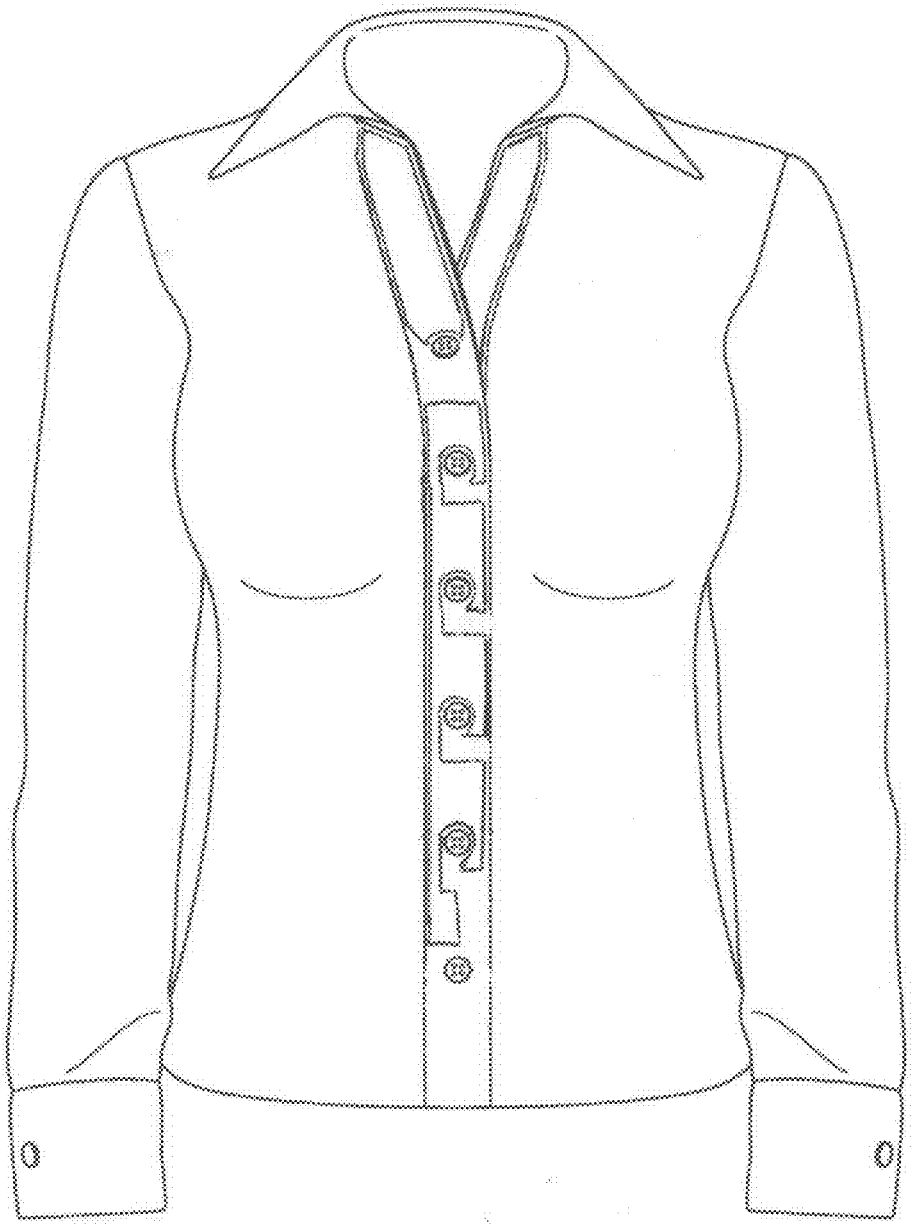
FIG. 14 shows a perspective view of a further embodiment, where a button shirt has a stay in the middle section of the placket which can insert from the inner side of the shirt's placket, with another stay in the top region of the placket which can insert from the top or side of the placket.

FIG. 14 shows another embodiment whereas two stays are shown. The stay in the upper region of the placket of the garment has been previously discussed. The lower stay offers a shape that can only insert into the placket from the inner side of the placket region, given it's a folded placket and doesn't have a sewn seam.

Figure 15:
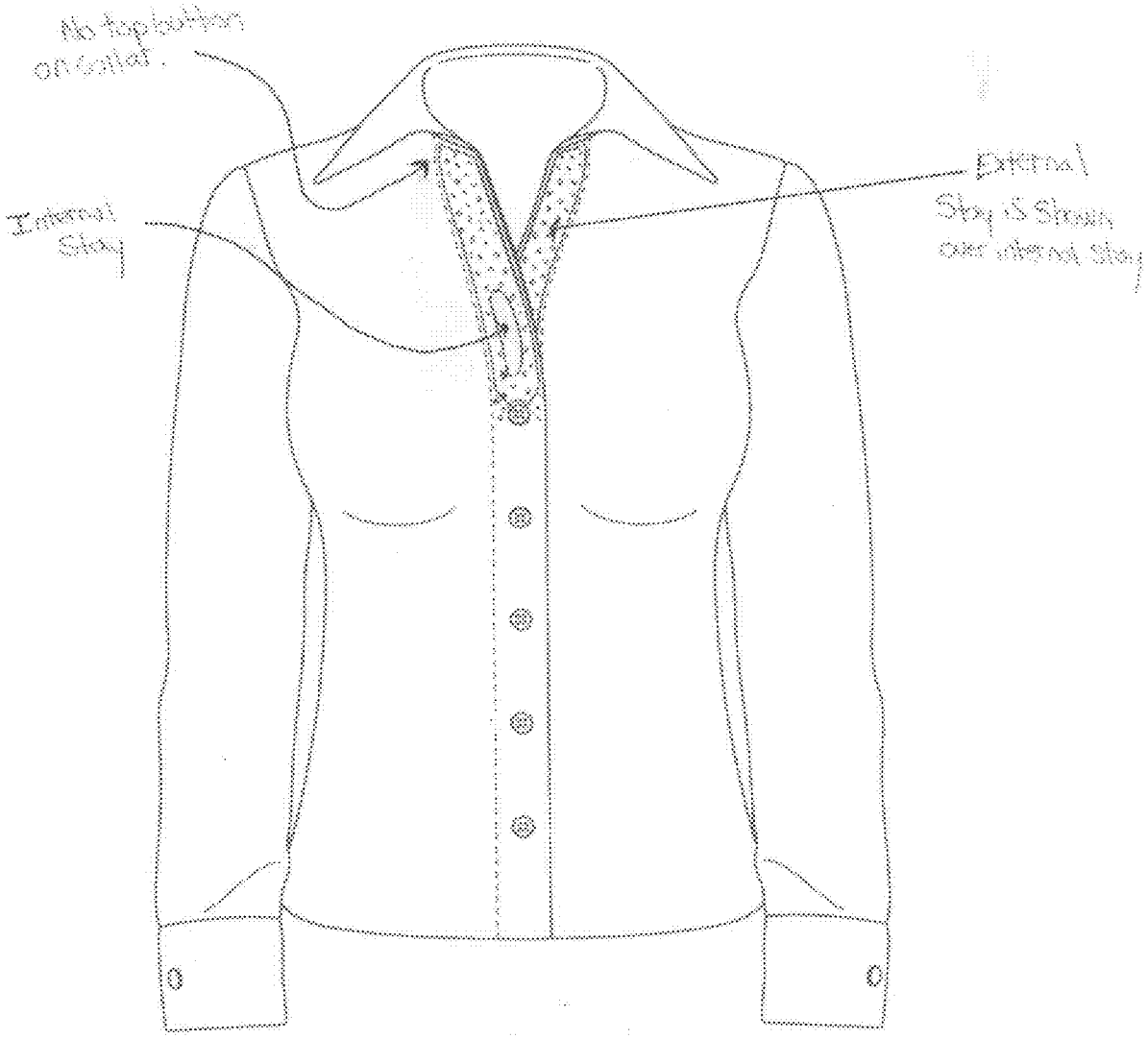
FIG. 15 shows a perspective view of yet another embodiment, where a button shirt has an inner stay and an outer stay at the upper region of the placket.

FIG. 15 shows another example of a shirt, but features an external stay that connects over an internal stay. This representation offers limitless possibilities of function and fashion. For example, the inner stay can be made to hold a specific shape and the outer stay follows the contour given by the internal stay, but adds decorative options of color, patterns, etc. to the shirt. Another example is if the internal stay is made of soft and pliable material, and the outer stay offers a specific shape or contour. In this example, the outer stay could be a thin ferrous material that allows for an anodized finish, special paint, embroidered logo, slogan, name, etc. This allows the outer stay to have marketing potential. The outer stay could also be made of non-ferrous material like carbon fiber for a sporty look. The outer stay could also come in a geometric shape or present an object, like a country's flag, spikes, a snake silhouette, and could come in a variety of shapes, colors, and styles. Internal stay shown in FIG. 15 is meant to be a window view of internal stay, which may be just as big as the external stay.

Figure 16:
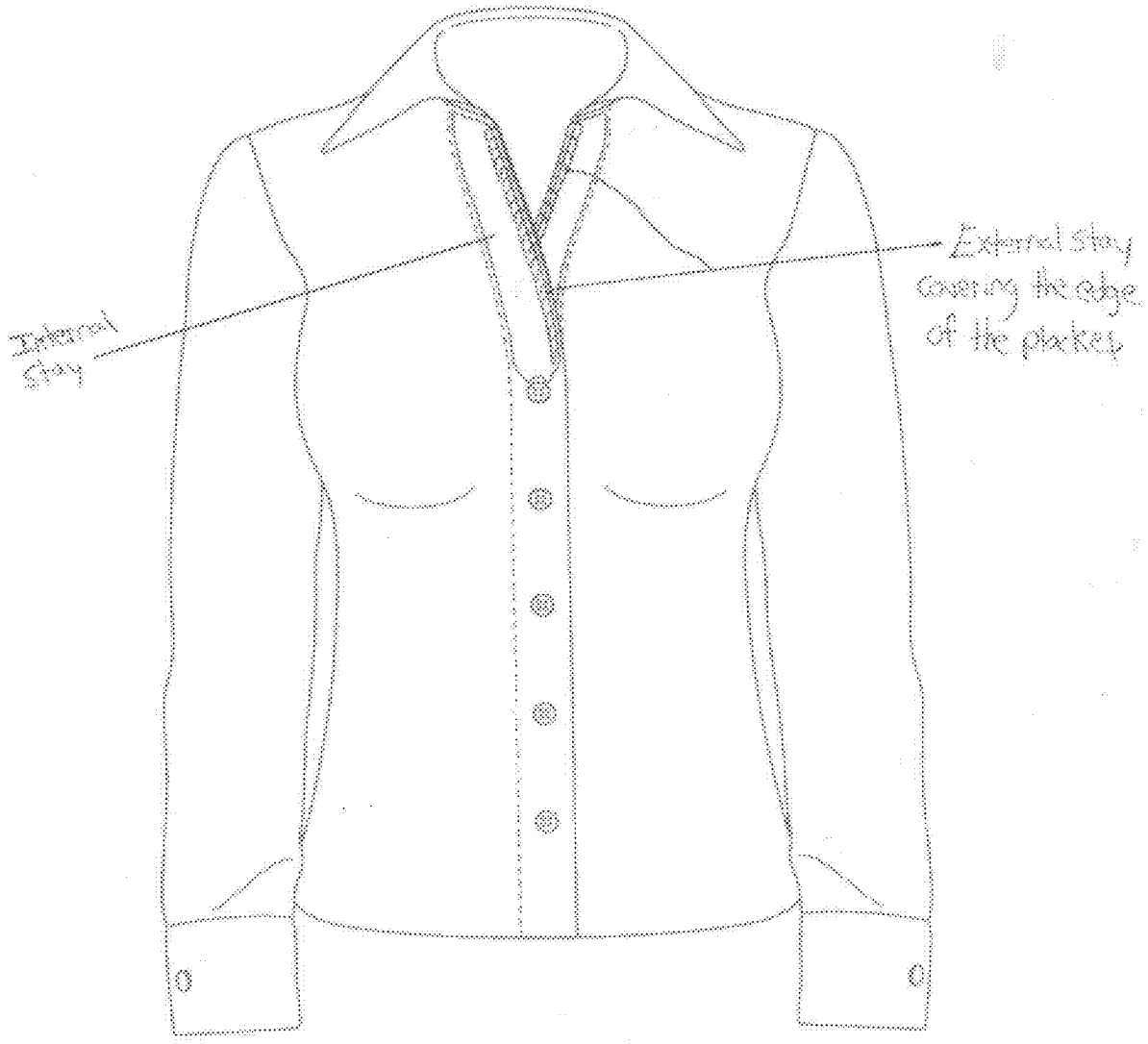
FIG. 16 shows a perspective view of a further embodiment of garment stay where a button shirt has an inner stay and an outer stay that covers the piping of the outer fold of the placket.

FIG. 16 shows an embodiment of a shirt wherein an internal stay is located in the upper placket region and an external stay covers the piping of the outer edge of the placket, while connecting to the outer side edge of the internal stay. This allows the internal stay to take on a shape or bend for style and allows the external stay to offer a different color or fabric option, offering unlimited possibilities of style options. Additionally, the stay is still functional as the top portion of the placket doesn't fall, bend, etc below the collar.

Figure 17:
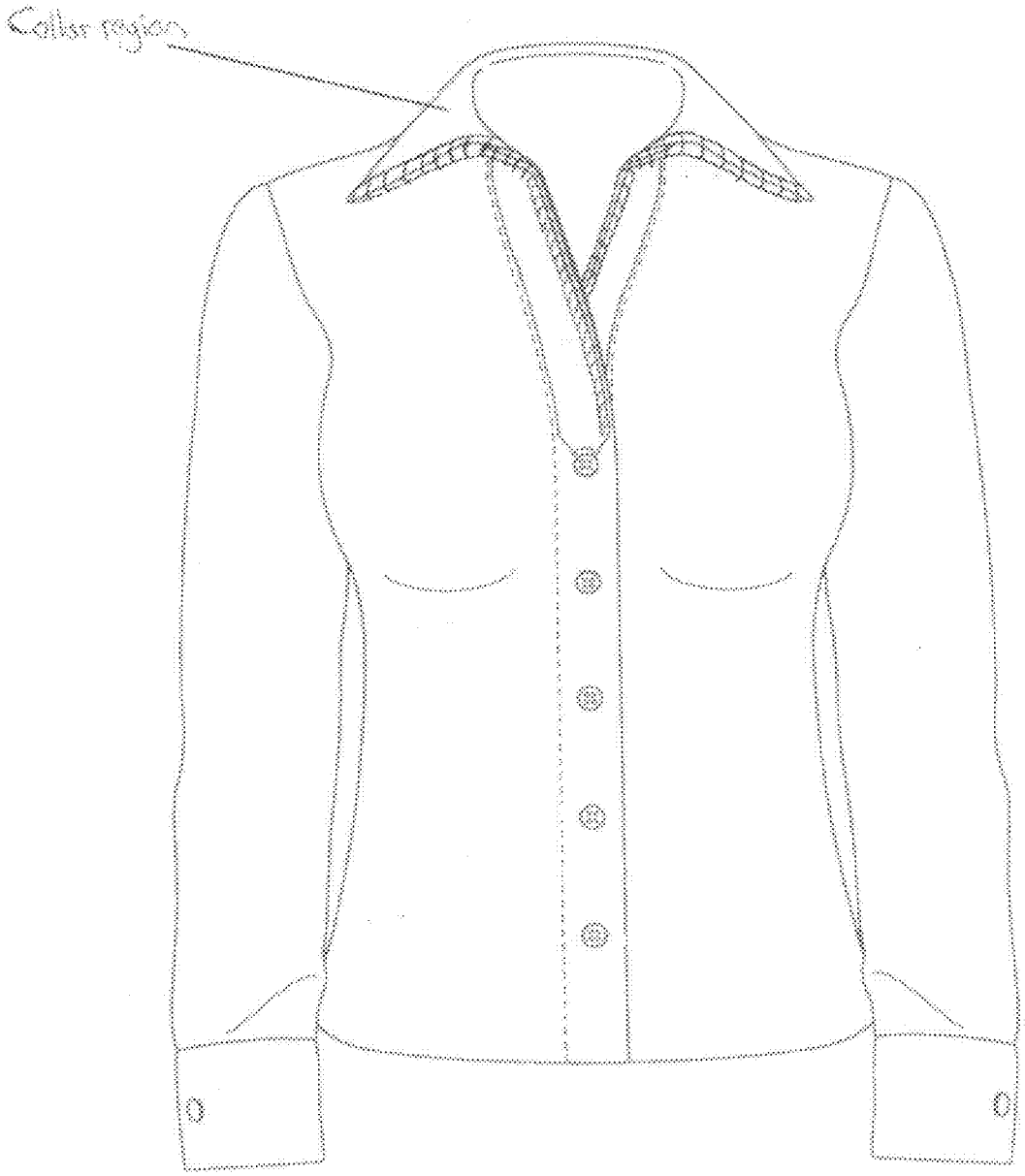
FIG. 17 is an embodiment similar to FIG. 16, but the external stay continues up the top of the placket, and along the outer edge of the shirt's collar.

FIG. 17 offers everything that FIG. 16 offers, but the external stay continues onto the collar. This can allow for a specific shape to the collar region of the shirt.

Figure 18:
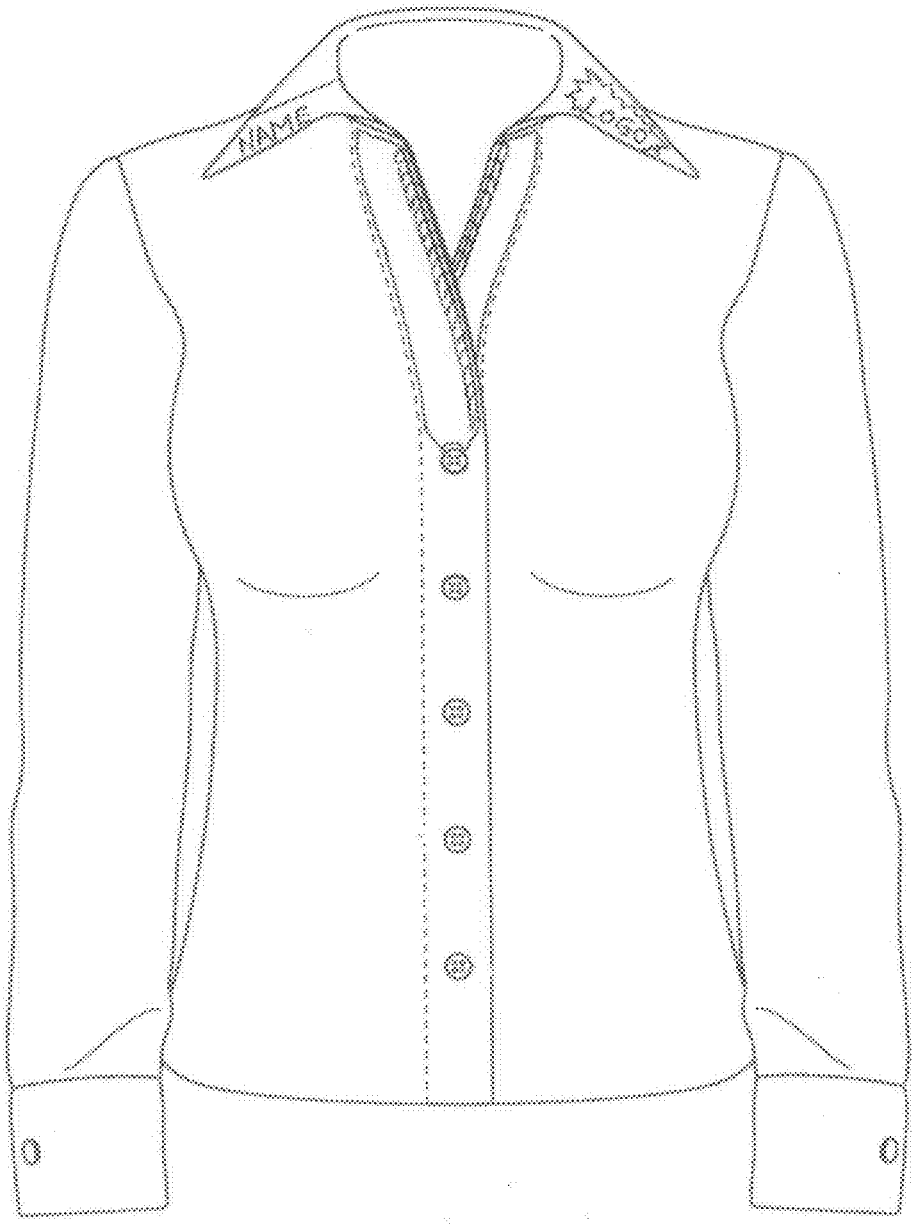
FIG. 18 is yet a further embodiment similar to the embodiment shown in FIG. 16, but an external stay is showcased on the collar offering a name or logo design.

FIG. 18 offers everything that FIG. 16 offers, but the external stay in the collar region is not connected to the piping of the external stay in the placket region. In this embodiment, the collar region offers a stay that can take on different shapes, colors, can brandish a logo, name, or object that the wearer likes. This offers even more options of function and fashion that the original garment doesn't offer.

Figure 19:
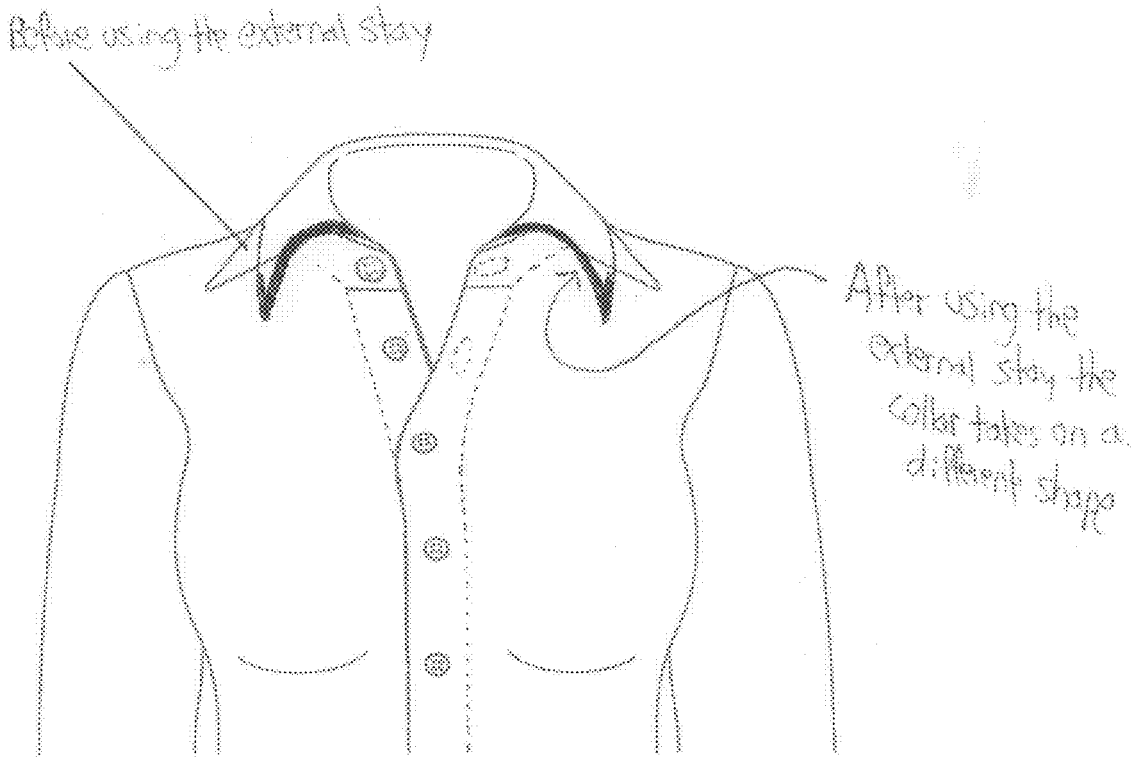
FIG. 19 is a perspective view of a button shirt which shows how an external stay on the collar of a button shirt can offer a user-desired shape to the collar.
Figure 22:
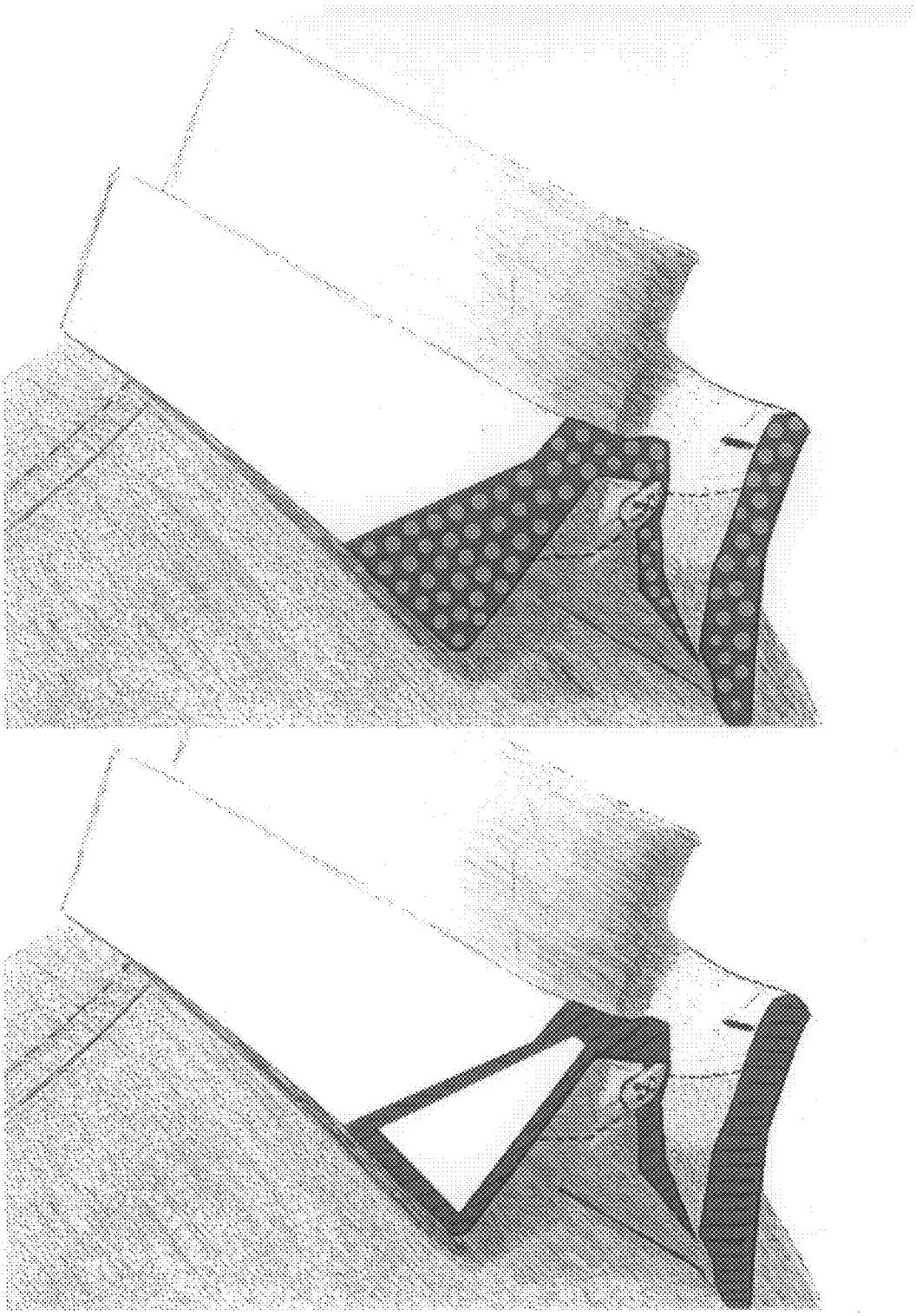
FIG. 22 shows a perspective view of two drawings. The top illustration shows a patterned external stay that continues from the placket region onto the collar. The bottom illustration is similar, but shows a cut-out design in the external stay on the collar.
Figure 23:
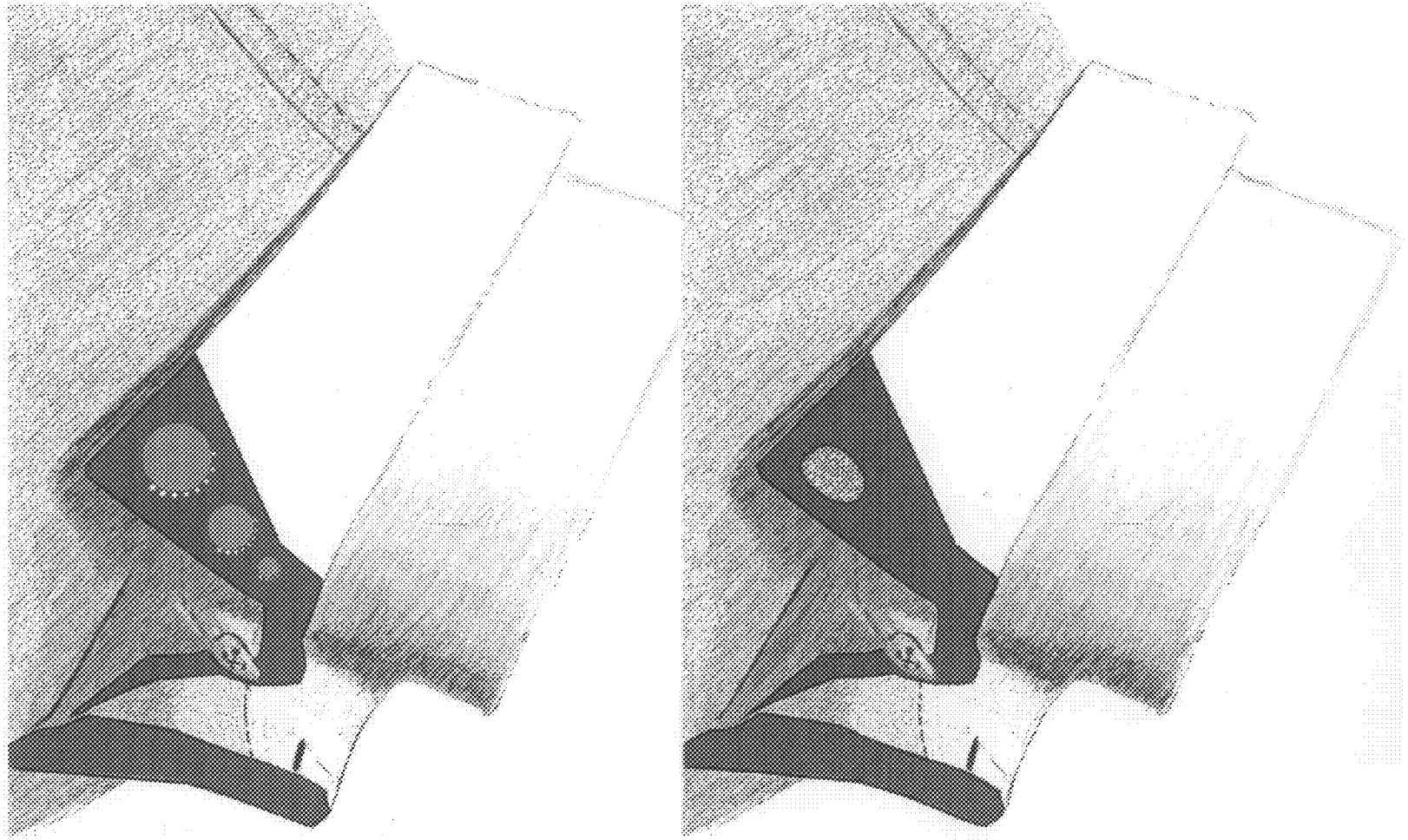
FIG. 23 are two embodiments similar to FIG. 22, but showing different designs in the collar portion of the external stay.
Figure 24:
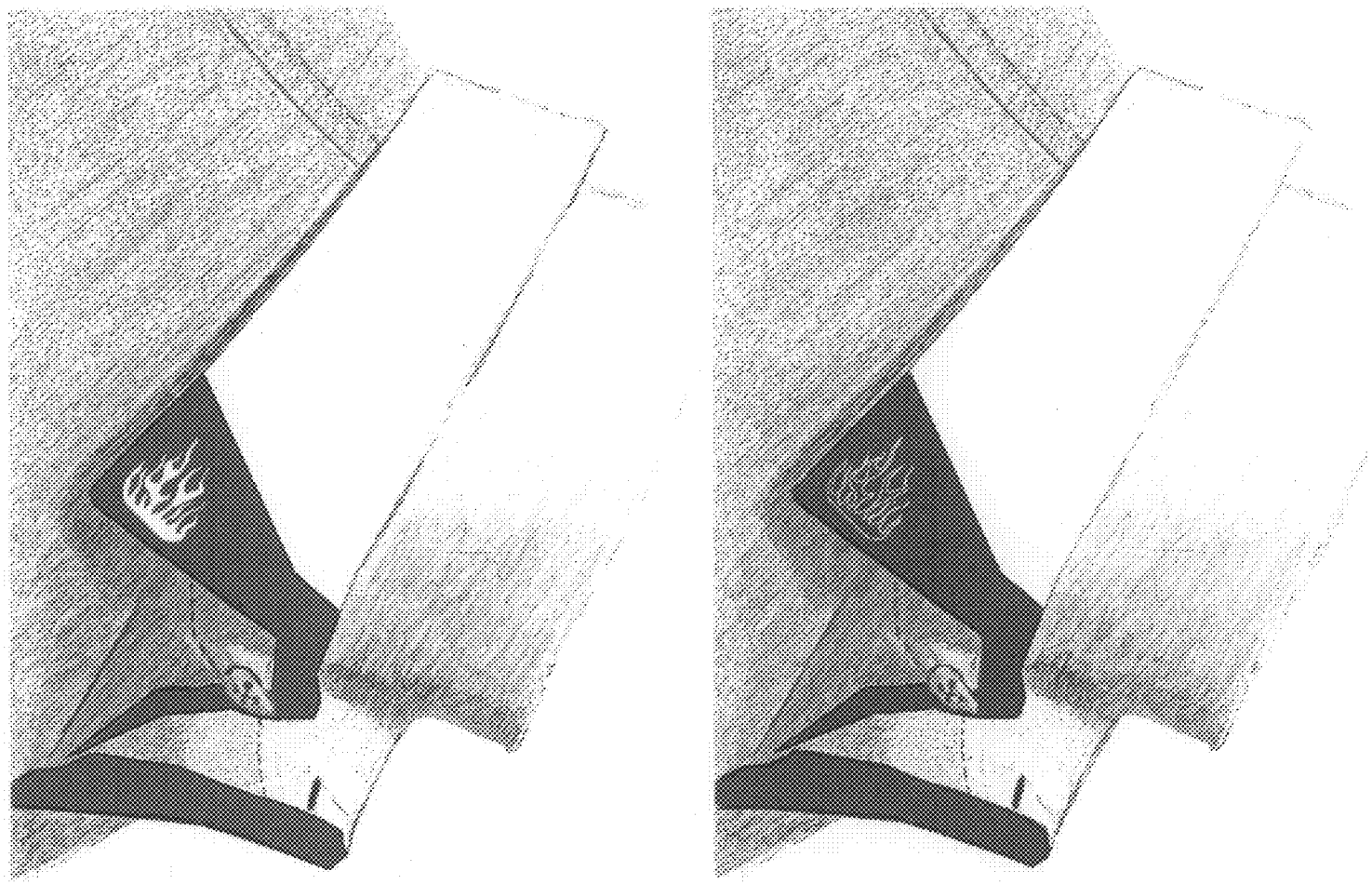
FIG. 24 are two embodiments similar to FIG. 22, but showing different designs in the collar portion of the external stay.

FIG. 19 shows an embodiment of a button shirt with and without an external stay attached to the collar region of the garment. Here, the external stay offers shape that the original garment doesn't offer, while offering color and style options in the shape or design of the stay.

FIG. 20 shows two drawings. One features a collapsed placket due to the shirt being unbuttoned and no use of an internal or external stay. The second drawing shows a more structured placket in the upper region of the shirt as a result of using an internal or external stay or combination of internal and external stays.

FIGS. 21, 22, 23, 24, and 25 show some different options, providing function and fashion features (a more structured upper placket region, collar, and different designs on showcased on the collar region).

Figure 26:
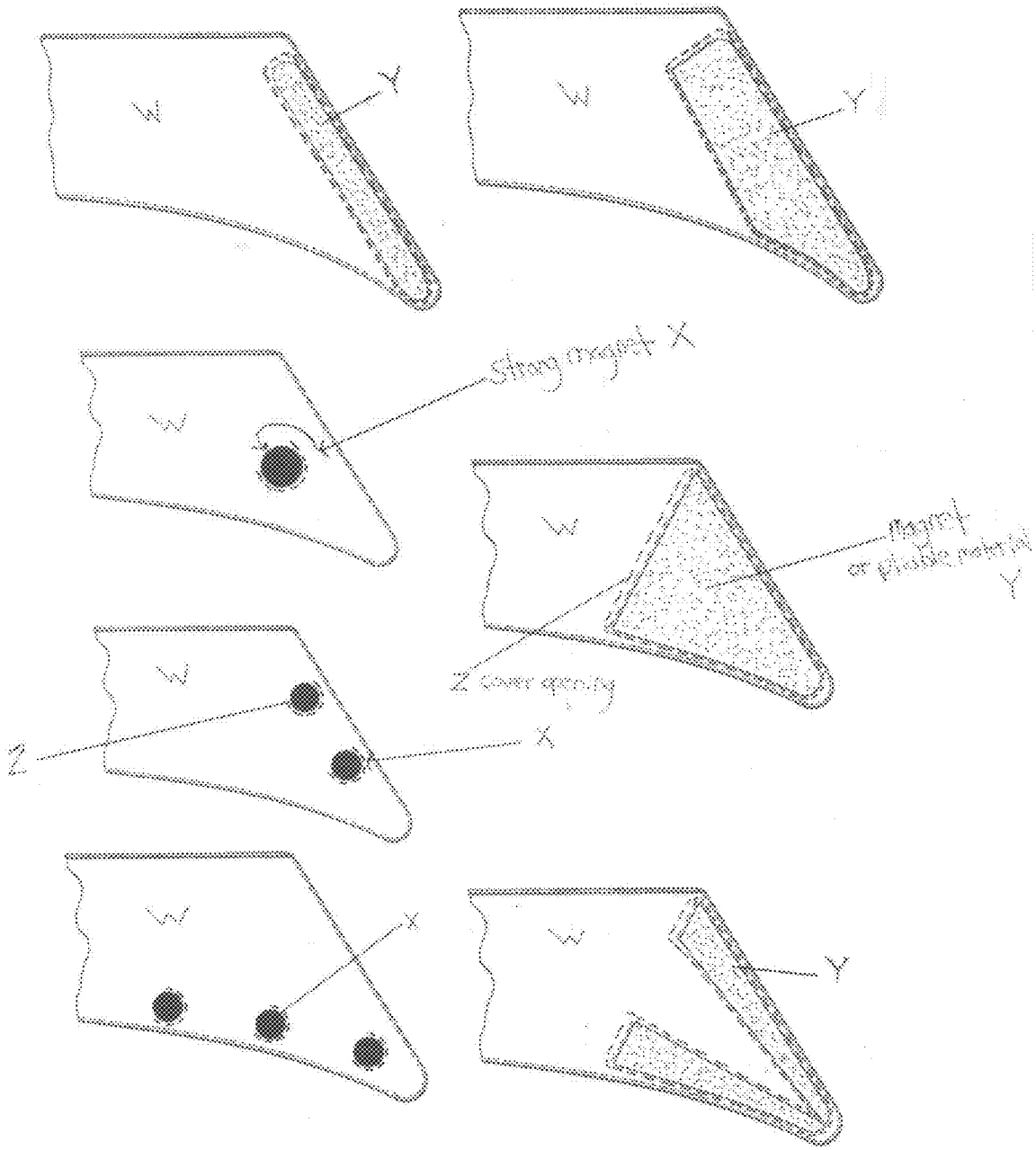
FIG. 26 is a perspective view of the underside and placement of magnets on the collar of a shirt or jacket, in some embodiments of the contemplated invention, so as to allow an external collar stay to stay planted on the collar.

FIG. 26 shows an embodiment of method to fasten, with different positions or locations on the inner collar to hold a strong magnet x, magnet or pliable material Y, along inner collar w. These are not collar stays but an anchoring means to attaching an external stay on the outside of the collar region. The strong magnet x, may not even need a cover to house them or cover opening z. The pliable material Y, may also be an option of connecting the external stay so there is sufficient material between the inside of the collar for the external stay to attach to.

FIG. 27 shows an embodiment like FIG. 17, but shows external collar region T, in relation to inner magnet or pliable material Y. An additional stay BB, is shown that could connect to the collar region T. Drawing BB could connect by use of Y magnet, could fit over the edge of the collar T and fit snugly to pliable material Y (a plastic insert, etc), at front side F of the collar. There are several methods of connection of stay BB to front collar F to T (by use of magnet, by fitting over the collar, by combination of fitting over the collar and having a clasp type or snap-on fitting edge that contours over the piping edge of the collar or by use of clasp G that keeps pressure against the inner side of collar W from FIG. 26.

Figure 29:
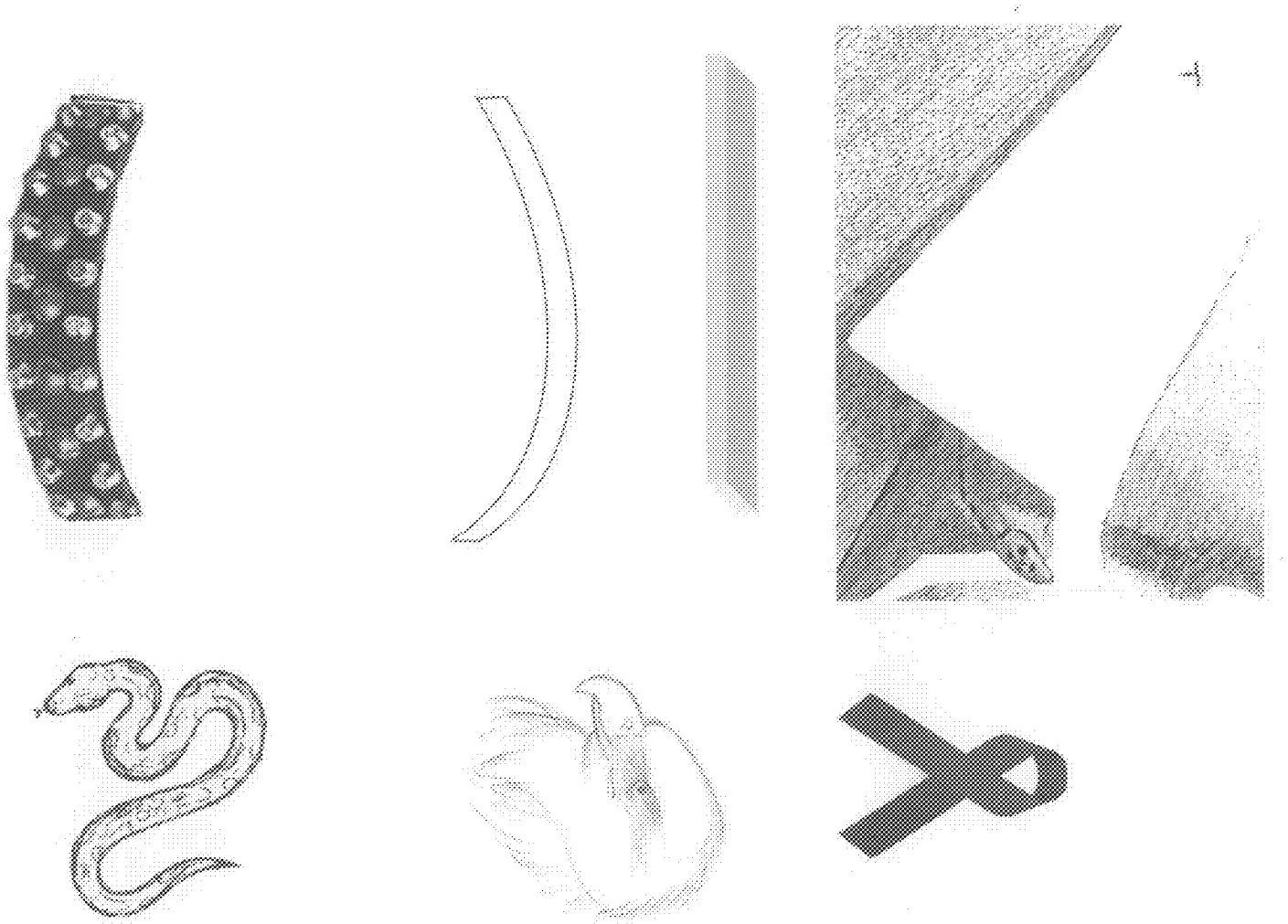
FIG. 29 shows a perspective view of a collar of a button shirt and different external stays that offer a particular message, style, and shape to the collar.

FIGS. 28, and 29 show examples of different styles of external stays that can attach externally to the collar T, while offering either a rigid straight shape to the collar or a bended shape for different style.

Thus, specific embodiments and applications of garments with stays, or detachable garment stays have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the invention. In addition, where the specification and claims refer to at least one of something selected from the group consisting of A, B, C . . . and N, the text should be interpreted as requiring only one element from the group, not A plus N, or B plus N, etc.

What is claimed is:

1. A garment with a user-shapeable contour of material, wherein at least one stay is attached internally for purposes of providing a user-desirable shape to said garment, the garment comprising:

a left having an outer and inner layers and a right placket region, at least one of which having an internal compartment disposed between said outer and inner layers;

wherein the left and right placket regions each has a top terminal end terminating at a neck hole of the garment;

the at least one stay disposed in said at least one internal compartment to provide a shape to the left or right placket region;

wherein at least one of said left or right placket region has an opening leading to said internal compartment, and to receive said stay to pass therethrough;

wherein the opening is disposed on an inner side, on a side, on a top, or on a bottom of the placket region;

wherein the at least one stay is entirely planar and has an upper distal end which is disposed at the top terminal end of the left or right placket regions;

wherein the garment is one selected from a group consisting of a jacket, a shirt, a polo shirt, a sport shirt, a buttoned shirt, a blazer, a suit jacket, a zipper-front jacket, a zipper-front shirt, a coat, a sweater, and a high collar shirt, jacket or coat.

2. The garment as recited in claim 1, wherein the at least one stay has a cut-out defining a channel oriented in parallel to a longitudinal axis of the at least one stay.

3. The garment as recited in claim 2, wherein the channel is connected to a bulbous cove.

4. The garment as recited in claim 3, wherein the at least one stay has a first appendage and a second appendage separated by the channel.

5. The garment as recited in claim 4, wherein the stay is made of ferrous or non-ferrous material, and is comprised of at least one of metal, stainless steel, plastic, fiberglass, carbon fiber, titanium, and aluminum; the stay has a catch capable of making an abutting engagement with a button or a button hole of the garment while being disposed within the at least one internal compartment, and wherein the second appendage is longer than the first appendage.

6. The garment as recited in claim 5 further comprising a main body coupled to said first appendage, wherein the first appendage is longer than said main body.

7. The garment as recited in claim 4, wherein said at least one stay disposed in either the left or the right placket is comprised of a first body and a second parallel body positioned in parallel to the first body, wherein the first body and second parallel body are received in the same internal compartment and are separated by at least one selected from the group consisting of a button, a button hole of the placket region, a parallel stitching, and a folded edge.

8. The garment as recited in claim 1, wherein the straight edge is perpendicular to a longitudinal axis of the at least one stay.

9. The garment as recited in claim 1, wherein the channel is connected to two coves.

10. The garment as recited in claim 1, wherein the second appendage has a terminal end that curves inward.

11. The garment as recited in claim 1, wherein the second appendage has an inner edge having a straight line disposed in between a first inward curve and a second inward curve.

12. A placket stay to provide shape to a placket of a garment, the placket stay comprises:

a main body;

a first appendage coupled to the main body;

a second appendage coupled to the main body, and wherein the second appendage is longer than the main body;

a cut-out channel disposed between the first and the second appendages;

at least one of a left or right placket region having an opening leading to an internal compartment disposed between an outer and an inner layers of said right or left placket regions, and to receive said stay to pass therethrough;

wherein the left and the right placket regions each has a top end terminating at a neck hole of the garment;

wherein the opening is disposed on the inner side of the placket region and on at least one of a side, on a top, or on a bottom part of the placket region; and wherein all parts of the placket stay is made from a single-piece planar material.

13. The placket stay as recited in claim 12, wherein the second appendage has a base portion, a middle portion, and a terminal portion, wherein the base portion is narrower than the middle portion.

14. The placket stay as recited in claim 13, wherein the base portion has a curved inside edge.

15. The placket stay as recited in claim 14, wherein the terminal portion has another curved inside edge.

16. The placket stay as recited in claim 14, wherein the middle portion is longer than the base portion and has equal width throughout the middle portion.

17. The placket stay as recited in claim 12 wherein the second appendage has an outer edge that curves inward at its terminal end.

18. The placket stay as recited in claim 12, wherein the second appendage is longer than the main body.

19. The placket stay as recited in claim 12, wherein the main body has a straight terminal end with two right angled corners.

* * * * *